US011139155B2

(12) United States Patent
Naito et al.

(10) Patent No.: US 11,139,155 B2
(45) Date of Patent: Oct. 5, 2021

(54) LASER DESORPTION/IONIZATION METHOD AND MASS SPECTROMETRY METHOD

(71) Applicant: HAMAMATSU PHOTONICS K.K., Hamamatsu (JP)

(72) Inventors: Yasuhide Naito, Hamamatsu (JP); Takayuki Ohmura, Hamamatsu (JP); Masahiro Kotani, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 16/762,971

(22) PCT Filed: Oct. 5, 2018

(86) PCT No.: PCT/JP2018/037454

§ 371 (c)(1),
(2) Date: May 11, 2020

(87) PCT Pub. No.: WO2019/106962

PCT Pub. Date: Jun. 6, 2019

(65) Prior Publication Data

US 2020/0273691 A1 Aug. 27, 2020

(30) Foreign Application Priority Data

Nov. 28, 2017 (JP) ..... JP2017-228144

(51) Int. Cl.
*H01J 49/00* (2006.01)
*H01J 49/04* (2006.01)
*H01J 49/06* (2006.01)

(52) U.S. Cl.
CPC ..... *H01J 49/0418* (2013.01); *H01J 49/0031* (2013.01); *H01J 49/0431* (2013.01); *H01J 49/068* (2013.01)

(58) Field of Classification Search
CPC ..... H01J 49/0418; H01J 49/0031; H01J 49/0431; H01J 49/068; H01J 49/164; G01N 27/62; G01N 27/64
(Continued)

(56) References Cited

U.S. PATENT DOCUMENTS 6,288,390 B1 9/2001 Siuzdak et al.
6,617,575 B1 * 9/2003 Cramer ..... H01J 49/0418 250/281

(Continued)

FOREIGN PATENT DOCUMENTS

JP H04-37542 B2 6/1992
JP H04-50982 B2 8/1992

(Continued)

OTHER PUBLICATIONS

International Preliminary Report on Patentability dated Jun. 11, 2020 for PCT/JP2018/037454.

(Continued)

*Primary Examiner* — Michael Maskell
(74) *Attorney, Agent, or Firm* — Faegre Drinker Biddle & Reath LLP

(57) ABSTRACT

A laser desorption/ionization method, includes: a first step of preparing a sample support body including a substrate on which a plurality of through holes opening to a first surface and a second surface facing each other are formed, and a conductive layer provided on at least the first surface; a second step of introducing a sample and a solvent having refractoriness in a vacuum into the plurality of through holes; and a third step of ionizing a component of the sample by irradiating the first surface with laser beam while applying a voltage to the conductive layer.

10 Claims, 14 Drawing Sheets

(58) Field of Classification Search
USPC ..... 250/281, 282, 288
See application file for complete search history.

(56) References Cited

U.S. PATENT DOCUMENTS

| | | | | |
|---|---|---|---|---|
| 7,695,978 | B2 | 4/2010 | Laprade et al. | |
| 2002/0094533 | A1 | 7/2002 | Hess et al. | |
| 2004/0026615 | A1* | 2/2004 | Ellson | G01N 35/1011 250/288 |
| 2004/0217277 | A1 | 11/2004 | Goodley et al. | |
| 2018/0158660 | A1* | 6/2018 | Naito | H01J 49/26 |
| 2020/0279729 | A1* | 9/2020 | Naito | G01N 27/64 |

FOREIGN PATENT DOCUMENTS

| | | | | |
|---|---|---|---|---|
| JP | 2721029 | B2 | 3/1998 | |
| JP | 2003-510776 | A | 3/2003 | |
| JP | 2009-080106 | A | 4/2009 | |
| JP | 5129628 | B2 | 1/2013 | |
| JP | 2013-520655 | A | 6/2013 | |
| WO | WO-01/23863 | A2 | 4/2001 | |
| WO | WO-2011/106198 | A1 | 9/2011 | |
| WO | WO-2017/038709 | A1 | 3/2017 | |
| WO | WO-2017038709 | A1 * | 3/2017 | H01J 49/164 |

OTHER PUBLICATIONS

"Refractory(disambiguation)", Wikipedia, Mar. 7, 2014, XP055825255.
"Refractory", Wikipedia, Jan. 29, 2016, XP055825252.

* cited by examiner (a)

(b)

LASER DESORPTION/IONIZATION METHOD AND MASS SPECTROMETRY METHOD

TECHNICAL FIELD

The present disclosure relates to a laser desorption/ionization method and a mass spectrometry method.

BACKGROUND ART

In the related art, a matrix-assisted laser desorption/ionization method (MALDI) is known as a method of ionizing a sample such as a biological sample in order to perform mass spectrometry or the like (for example, refer to Patent Literature 1). The MALDI is a method of ionizing a sample by adding a low-molecular-weight organic compound referred to as a matrix that absorbs laser beam into the sample, and by irradiating the sample with laser beam. According to such a method, it is possible to ionize a thermally unstable substance or a high-molecular-weight substance in a non-destructive manner (so-called soft ionization).

On the other hand, a surface-assisted laser desorption/ionization method (SALDI) is known as a method of performing ionization without using the matrix (for example, refer to Patent Literatures 2 and 3). The SALDI is a method of ionizing a sample by dropping the sample onto an ionization substrate having a fine concavo-convex structure on a surface, and by irradiating the sample with laser beam.

CITATION LIST

Patent Literature

Patent Literature 1: U.S. Pat. No. 7,695,978
Patent Literature 2: Japanese Patent No. 5129628
Patent Literature 3: U.S. Pat. No. 6,288,390

SUMMARY OF INVENTION

Technical Problem

In the mass spectrometry, the ionized sample is detected, and the mass spectrometry of the sample is performed on the basis of a detection result thereof. Therefore, in the mass spectrometry, it is desirable to improve a detection intensity (a sensitivity) of the ionized sample.

Therefore, an object of the present disclosure is to provide a laser desorption/ionization method and a mass spectrometry method in which in mass spectrometry, a detection intensity of an ionized sample can be improved.

Solution to Problem

A laser desorption/ionization method of one aspect of the present disclosure, includes: a first step of preparing a sample support body including a substrate on which a plurality of through holes opening to a first surface and a second surface facing each other are formed, and a conductive layer provided on at least the first surface; a second step of introducing a sample and a solvent having refractoriness in a vacuum into the plurality of through holes; and a third step of ionizing a component of the sample by irradiating the first surface with laser beam while applying a voltage to the conductive layer.

In the laser desorption/ionization method, the sample and the solvent are introduced into the plurality of through holes. The component of the sample is remained on the first surface side in each of the through holes, along with the solvent. Then, in a case where the first surface is irradiated with the laser beam while the voltage is applied to the conductive layer, energy is transmitted to the component of the sample on the first surface side. Accordingly, the component of the sample is ionized. In the laser desorption/ionization method, the solvent has refractoriness in a vacuum. For this reason, the solvent is more reliably remained on the first surface side, compared to a case where the solvent has volatility in a vacuum. Therefore, the component of the sample is also more reliably remained on the first surface side. Accordingly, when the first surface is irradiated with the laser beam while the voltage is applied to the conductive layer, the component of the sample is more reliably ionized. As described above, according to the laser desorption/ionization method, in mass spectrometry, it is possible to improve a detection intensity of the ionized sample.

In the laser desorption/ionization method of one aspect of the present disclosure, in the second step, a mixed liquid of the sample and the solvent may be dropped onto a mounting surface of a mounting portion, and the sample support body may be disposed on the mixed liquid such that the second surface is in contact with the mixed liquid, and in the third step, the component of the sample in the mixed liquid that is moved to the first surface side from the second surface side through the through hole may be ionized by irradiating the first surface with the laser beam while applying the voltage to the conductive layer. In this case, the mixed liquid containing the sample is moved to the first surface side from the second surface side through each of the through holes. The mixed liquid is remained on the first surface side in each of the through holes. Then, as described above, the component of the sample is more reliably remained on the first surface side, and is more reliably ionized. Accordingly, in the mass spectrometry, it is possible to improve the detection intensity of the ionized sample.

In the laser desorption/ionization method of one aspect of the present disclosure, in the second step, the sample support body may be mounted on the mounting surface such that the second surface faces the mounting surface of the mounting portion, and the mixed liquid of the sample and the solvent may be dropped into the plurality of through holes from the first surface side, and in the third step, the component of the sample in the mixed liquid that is remained on the first surface side may be ionized by irradiating the first surface with the laser beam while applying the voltage to the conductive layer. In this case, the mixed liquid containing the sample is moved to the second surface side from the first surface side through each of the through holes, and each of the through holes is filled with the mixed liquid. The mixed liquid is remained on the first surface side in each of the through holes. Then, as described above, the component of the sample is more reliably remained on the first surface side, and is more reliably ionized. Accordingly, in the mass spectrometry, it is possible to improve the detection intensity of the ionized sample.

In the laser desorption/ionization method of one aspect of the present disclosure, in the second step, the sample may be mounted on the mounting surface of the mounting portion, the sample support body may be disposed on the sample such that the second surface is in contact with the sample, and then, the solvent may be introduced into the plurality of through holes, and in the third step, the component of the sample that is mixed with the solvent and is moved to the first surface side from the second surface side through the through hole may be ionized by irradiating the first surface with the laser beam while applying the voltage to the conductive layer, in a state in which the sample is disposed between the mounting portion and the sample support body. In this case, the solvent is moved to the second surface side from the first surface side through each of the through holes, and is mixed with the component of the sample. The component of the sample is mixed with the solvent and is moved to the first surface side from the second surface side through each of the through holes. The component of the sample is remained on the first surface side, along with the solvent. Then, as described above, the component of the sample is more reliably remained on the first surface side, and is more reliably ionized. Accordingly, in the mass spectrometry, it is possible to improve the detection intensity of the ionized sample.

In the laser desorption/ionization method of one aspect of the present disclosure, in the second step, the solvent may be introduced into the plurality of through holes, the sample may be mounted on the mounting surface of the mounting portion, and then, the sample support body may be disposed on the sample such that the second surface is in contact with the sample, and in the third step, the component of the sample that mixed with the solvent and is moved to the first surface side from the second surface side through the through hole may be ionized by irradiating the first surface with the laser beam while applying the voltage to the conductive layer, in a state in which the sample is disposed between the mounting portion and the sample support body. In this case, the sample support body in which the solvent is introduced into the plurality of through holes is disposed on the sample. The component of the sample is mixed with the solvent and is moved to the first surface side from the second surface side through each of the through holes. The component of the sample is remained on the first surface side, along with the solvent. Then, as described above, the component of the sample is more reliably remained on the first surface side, and is more reliably ionized. Accordingly, in the mass spectrometry, it is possible to improve the detection intensity of the ionized sample.

In the laser desorption/ionization method of one aspect of the present disclosure, in the second step, the solvent may be dropped into the plurality of through holes from the first surface side. In this case, it is possible to easily introduce the solvent into each of the through holes.

In the laser desorption/ionization method of one aspect of the present disclosure, in the second step, the solvent may be dropped into the plurality of through holes from the first surface side or the second surface side. In this case, it is possible to easily introduce the solvent into each of the through holes.

In the laser desorption/ionization method of one aspect of the present disclosure, in the second step, the sample support body may be dipped in the solvent. In this case, it is possible to easily introduce the solvent into each of the through holes.

In the laser desorption/ionization method of one aspect of the present disclosure, in the second step, the solvent may be introduced into the plurality of through holes in a state of being heated and evaporate. In this case, it is possible to easily introduce the solvent into each of the through holes.

In the laser desorption/ionization method of one aspect of the present disclosure, the sample may be a dry sample. In the laser desorption/ionization method, the component of the sample is mixed with the solvent and is moved, and thus, even in a case where the sample is the dry sample, it is possible to smoothly move the component of the sample.

A laser desorption/ionization method of one aspect of the present disclosure, includes: a first step of preparing a sample support body including a substrate having conductivity on which a plurality of through holes opening to a first surface and a second surface facing each other are formed; a second step of introducing a sample and a solvent having refractoriness in a vacuum into the plurality of through holes; and a third step of ionizing a component of the sample by irradiating the first surface with laser beam while applying a voltage to the substrate.

According to the laser desorption/ionization method, it is possible to omit the conductive layer from the sample support body, and to obtain the same effect as that of a case where the sample support body including the conductive layer as described above is used.

In the laser desorption/ionization method of one aspect of the present disclosure, the solvent may be at least one selected from glycerin, diethanol amine, triethanol amine, nitrobenzyl alcohol, nitrophenyl octyl ether, thioglycerol, diethylene glycol, triethylene glycol, tetraethylene glycol, liquid paraffin, sulfolane, dithiothreitol, a mixture of dithiothreitol and thioglycerol, a mixture of dithiothreitol and nitrobenzyl alcohol, and a mixture of dithiothreitol and dithioerythritol. In this case, in the mass spectrometry, it is possible to improve the detection intensity of the ionized sample by using the solvent having refractoriness in a vacuum.

A mass spectrometry method of one aspect of the present disclosure, includes: each of the steps of the laser desorption/ionization method described above; and a fourth step of detecting the component that is ionized in the third step.

According to the mass spectrometry method, it is possible to improve the detection intensity of the ionized sample.

Advantageous Effects of Invention

According to the present disclosure, it is possible to provide a laser desorption/ionization method and a mass spectrometry method in which in mass spectrometry, a detection intensity of an ionized sample can be improved.

Figure 7:
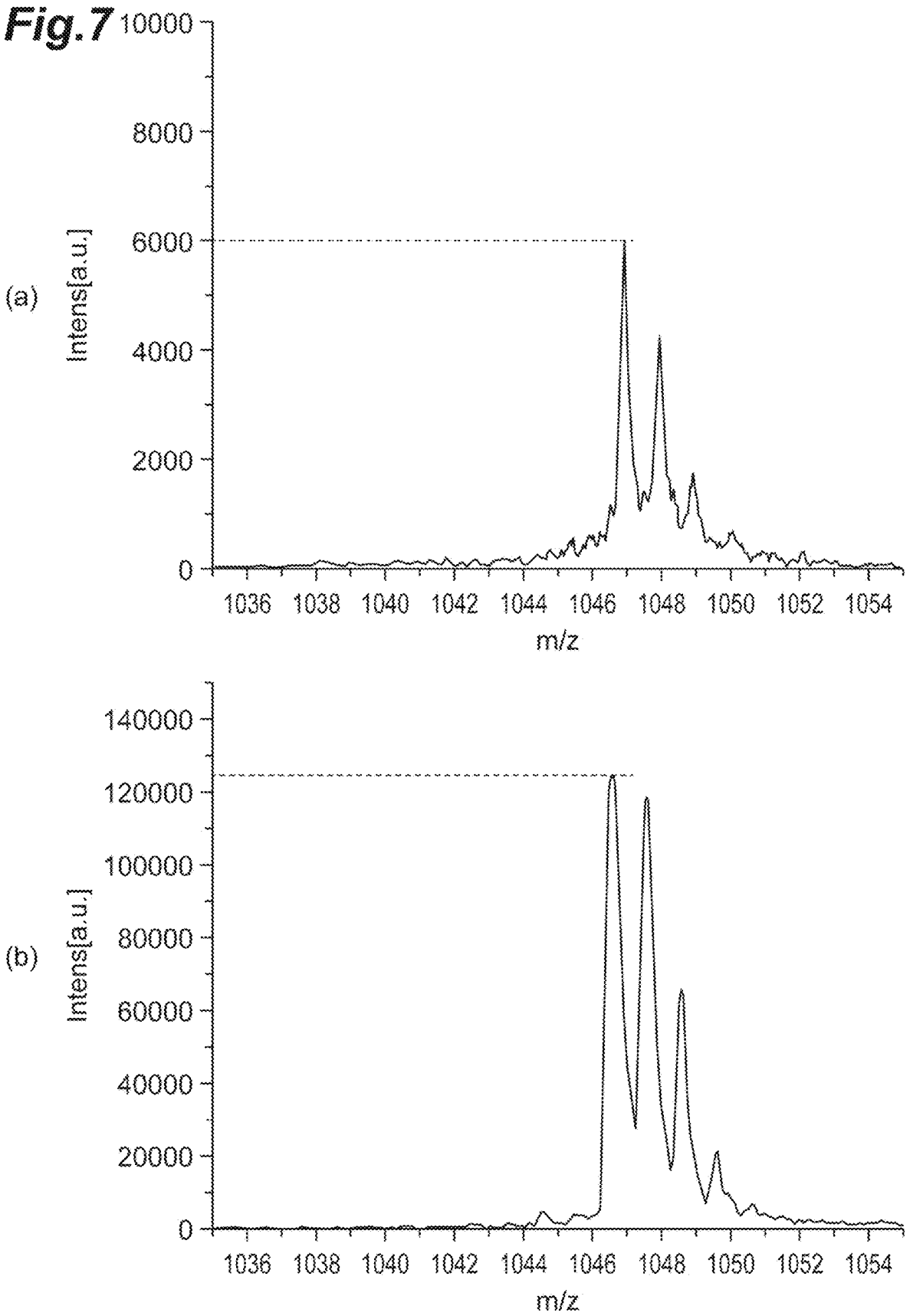

(a) of FIG. 7 is a mass spectrum of a mass spectrometry method of a comparative example and (b) of FIG. 7 is a mass spectrum of a mass spectrometry method of an example.

Figure 8:
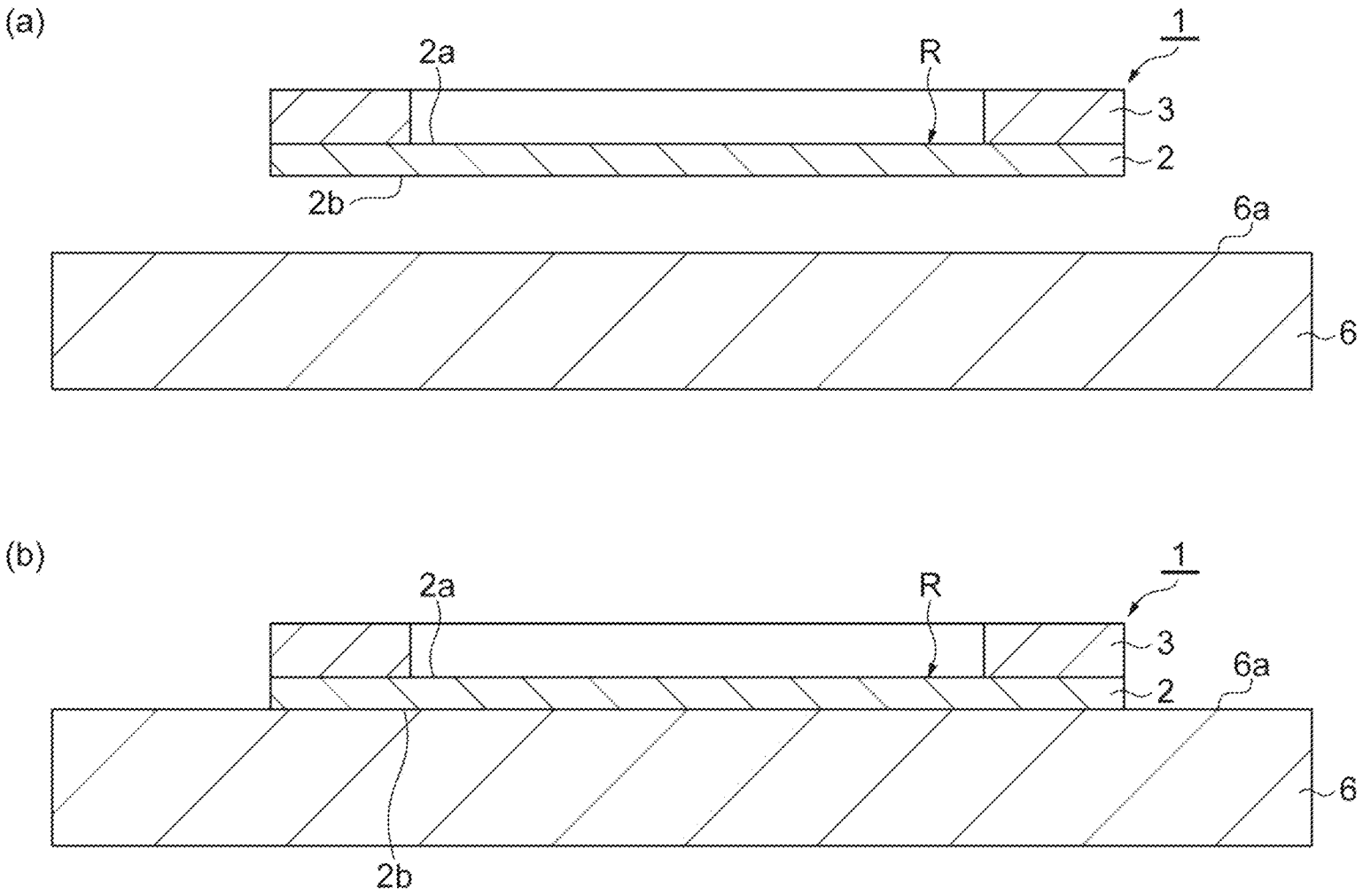

FIG. 8 is a diagram illustrating steps of a mass spectrometry method of a second embodiment.

Figure 9:
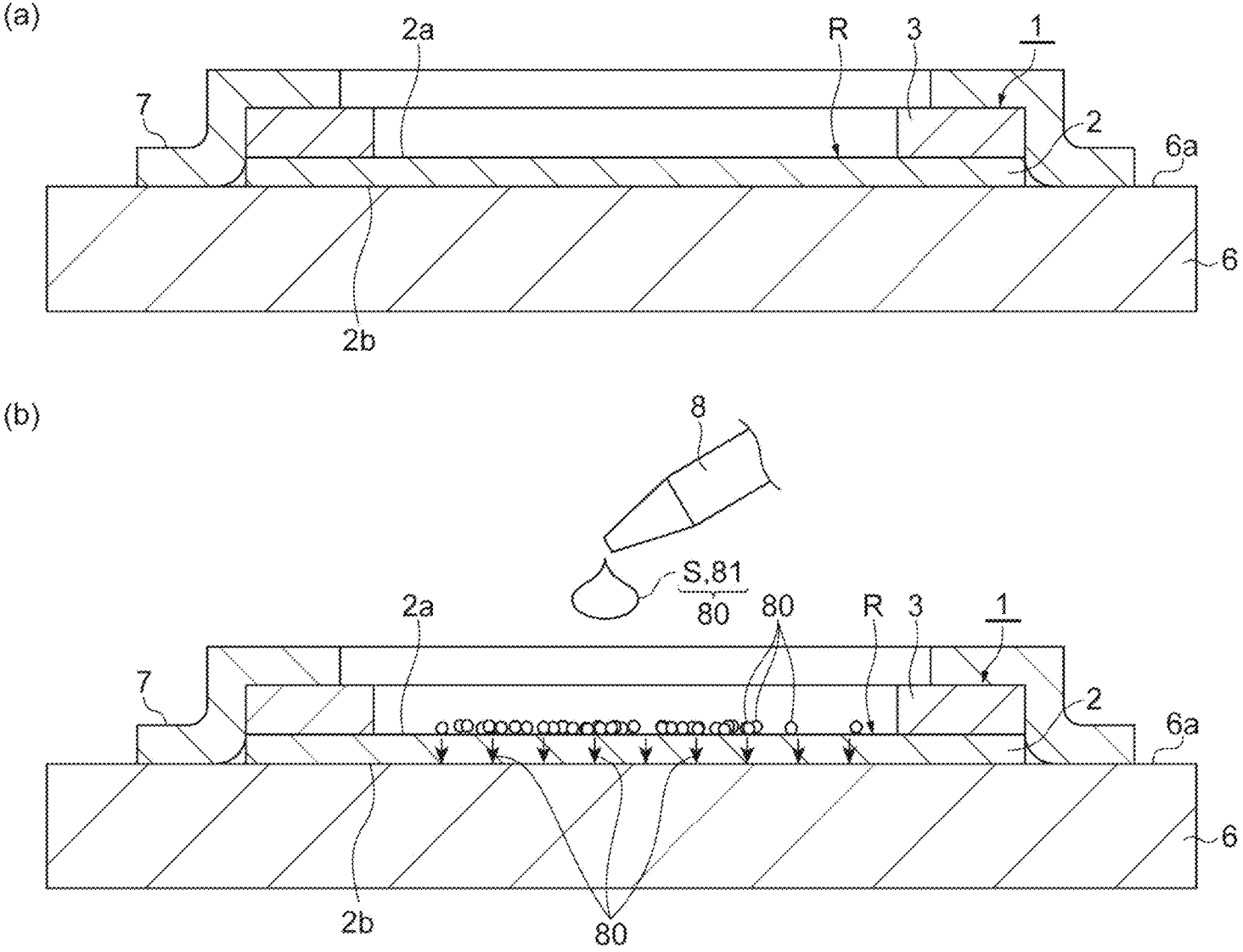

FIG. 9 is a diagram illustrating the steps of the mass spectrometry method of the second embodiment.

Figure 10:
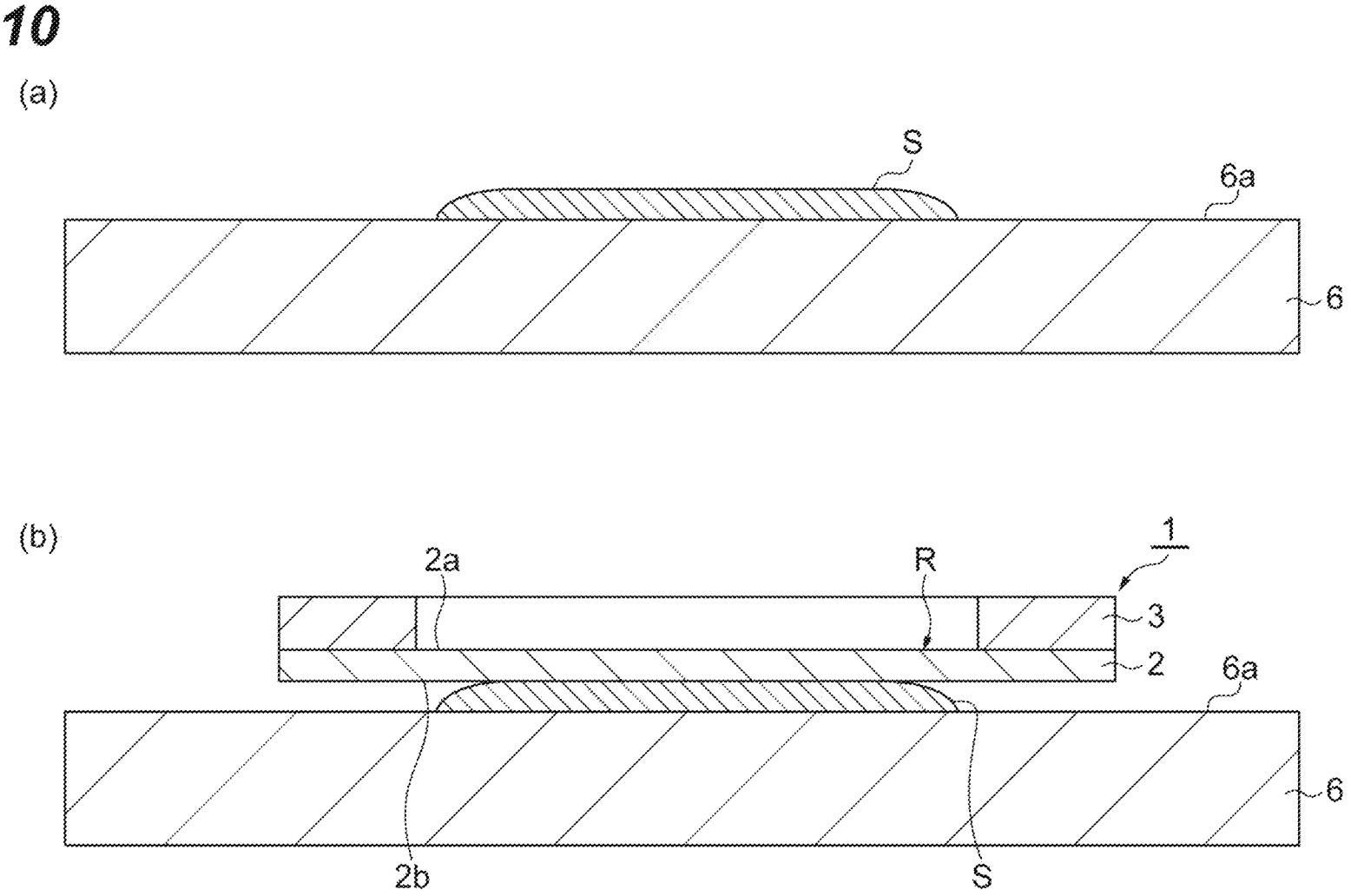

FIG. 10 is a diagram illustrating steps of a mass spectrometry method of a third embodiment.

Figure 11:
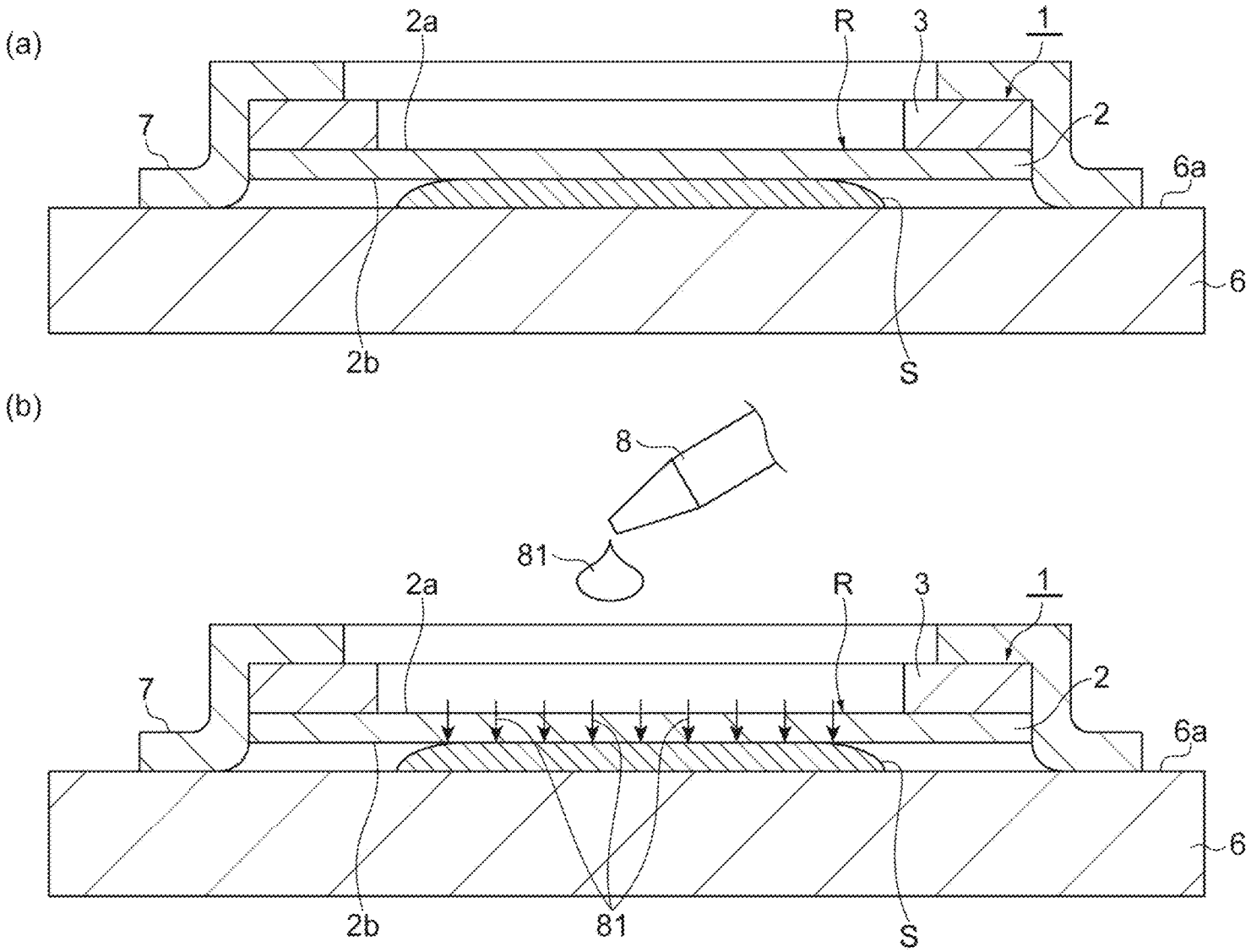

FIG. 11 is a diagram illustrating the steps of the mass spectrometry method of the third embodiment.

Figure 12:
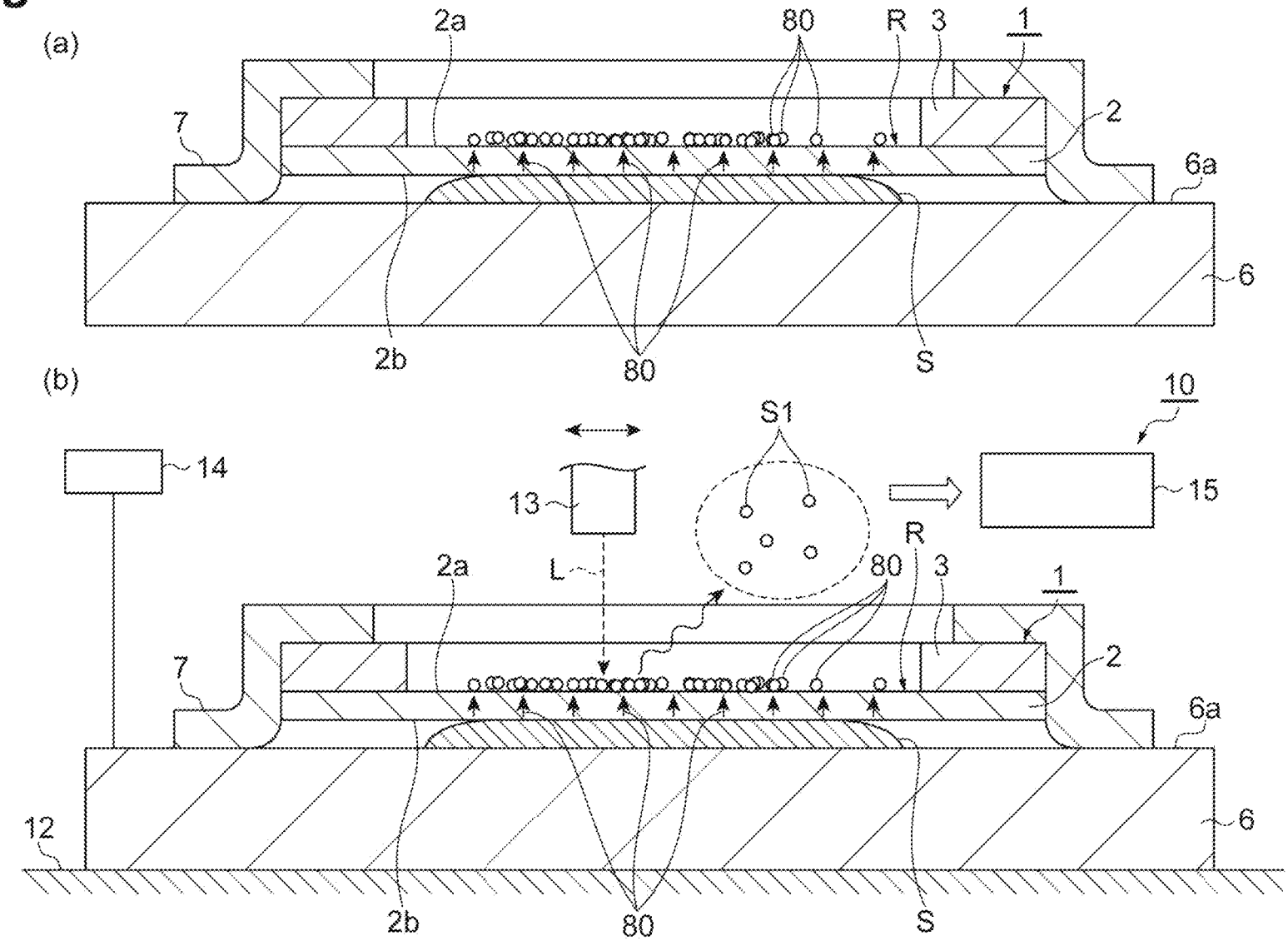

FIG. 12 is a diagram illustrating the steps of the mass spectrometry method of the third embodiment.

Figure 13:
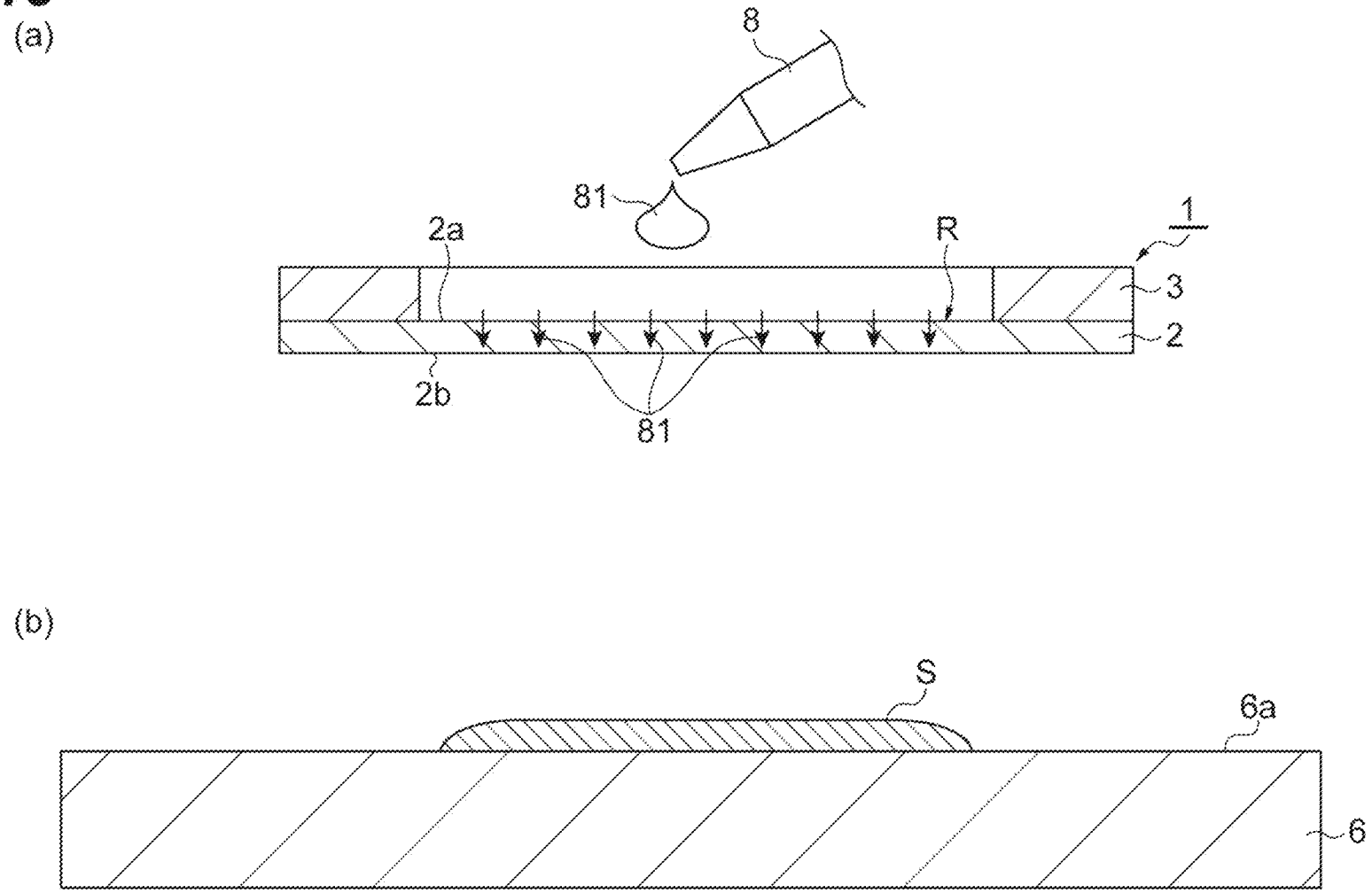

FIG. 13 is a diagram illustrating steps of a mass spectrometry method of a fourth embodiment.

Figure 14:
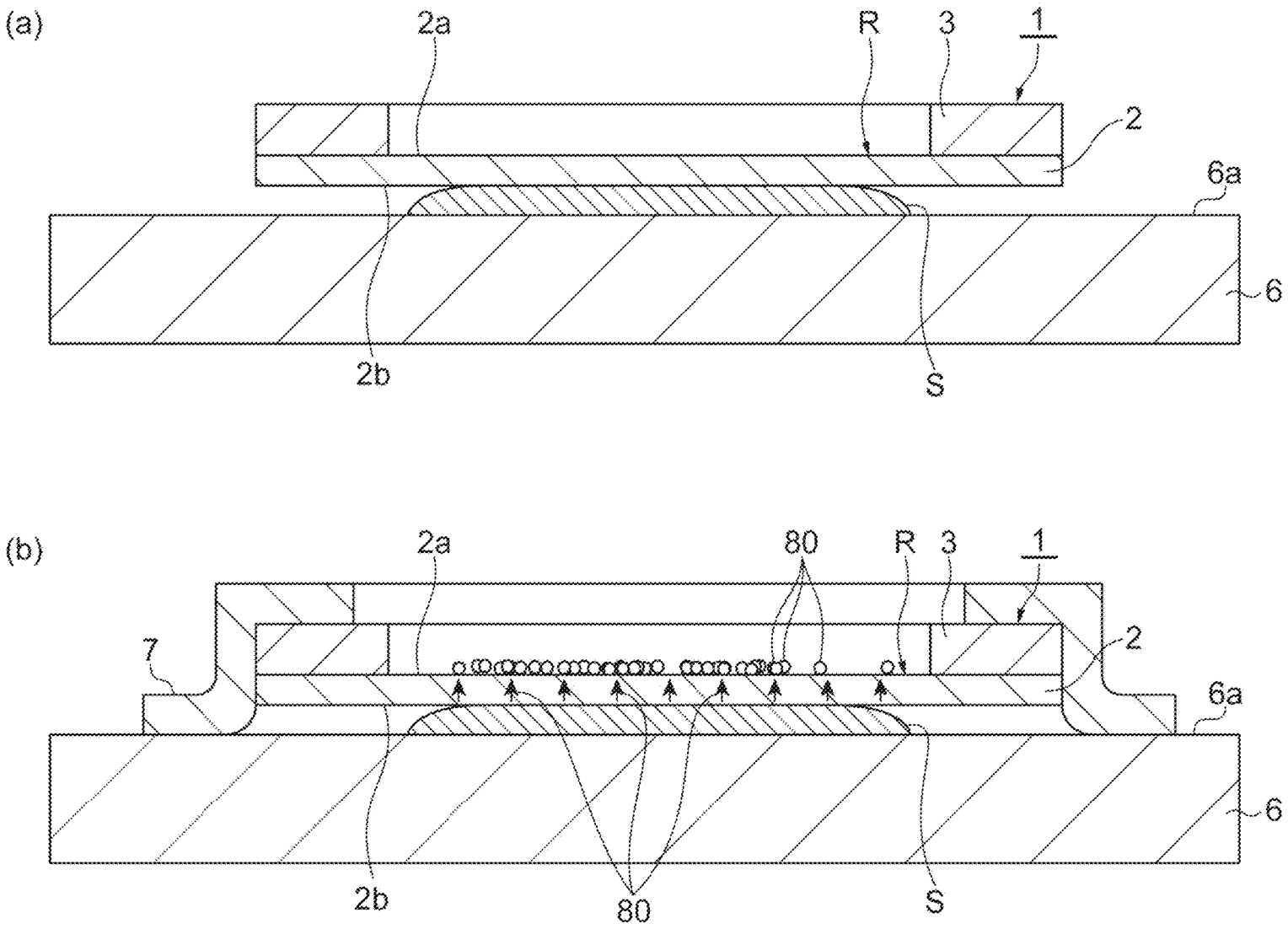

FIG. 14 is a diagram illustrating steps of a mass spectrometry method of the fourth embodiment.

DESCRIPTION OF EMBODIMENTS

Hereinafter, embodiments of the present invention will be described in detail with reference to the drawings. Note that, in each of the drawings, the same reference numerals will be applied to the same portions or the corresponding portions, and the repeated description will be omitted.

First Embodiment

Figure 1:
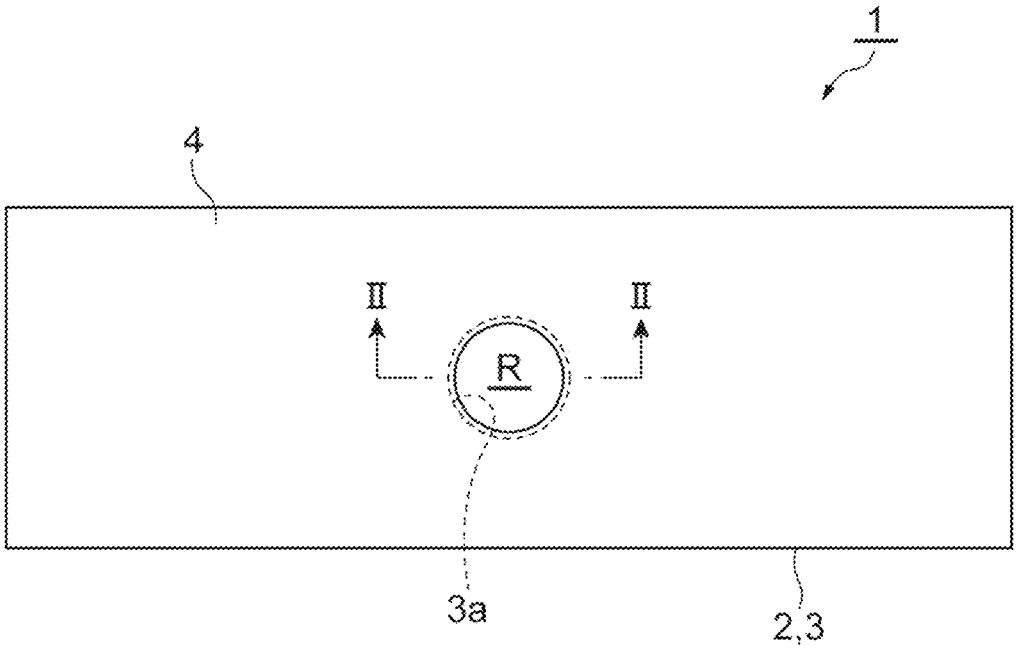
FIG. 1 is a plan view of a sample support body that is used in a laser desorption/ionization method and a mass spectrometry method of a first embodiment.
Figure 2:
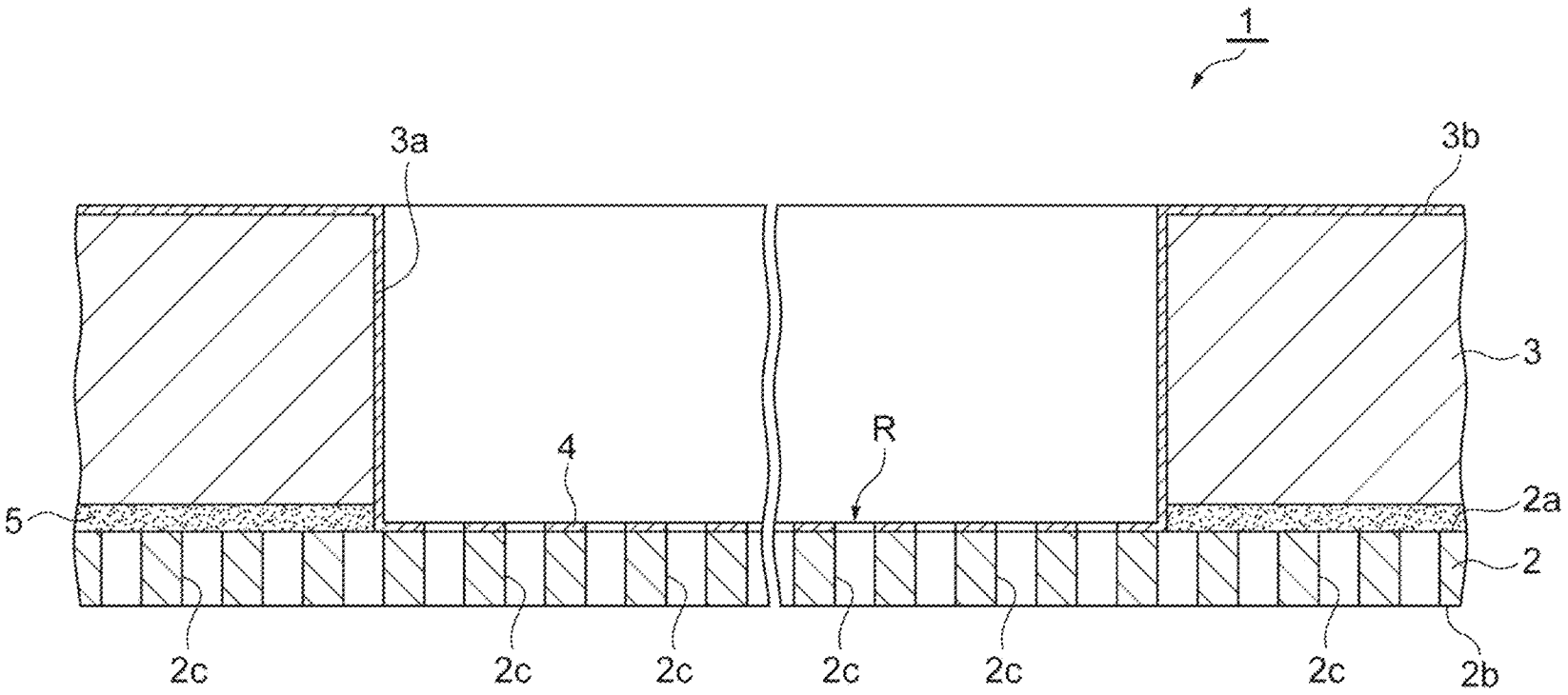
FIG. 2 is a sectional view of the sample support body along line II-II illustrated in FIG. 1.

First, a sample support body that is used in a laser desorption/ionization method and a mass spectrometry method of a first embodiment to a fourth embodiment will be described. As illustrated in FIG. 1 and FIG. 2, a sample support body 1 includes a substrate 2, a frame 3, and a conductive layer 4. The substrate 2 includes a first surface 2*a* and a second surface 2*b* facing each other. A plurality of through holes 2*c* are formed on the substrate 2 uniformly (with a homogeneous distribution). Each of the through holes 2*c* extends along a thickness direction of the substrate 2 (a direction perpendicular to the first surface 2*a* and the second surface 2*b*), and opens to the first surface 2*a* and the second surface 2*b*.

The substrate 2, for example, is formed of an insulating material into the shape of a rectangular plate. The length of one side of the substrate 2 when seen from the thickness direction of the substrate 2, for example, is approximately several cm, and the thickness of the substrate 2, for example, is approximately 1 μm to 50 μm. The through hole 2*c*, for example, is approximately in the shape of a circle when seen from the thickness direction of the substrate 2. The width of the through hole 2*c* is 1 nm to 700 nm. The width of the through hole 2*c* indicates the diameter of the through hole 2*c* in a case where the through hole 2*c* is approximately in the shape of a circle when seen from the thickness direction of the substrate 2, and indicates the diameter (an effective diameter) of a virtual maximum cylinder falling into the through hole 2*c* in a case where the through hole 2*c* is not approximately in the shape of a circle. A pitch between the respective through holes 2*c* is 1 nm to 1000 nm. In a case where the through hole 2*c* is approximately in the shape of a circle when seen from the thickness direction of the substrate 2, the pitch between the respective through holes 2*c* indicates a center-to-center distance of the respective circles, and in a case where the through hole 2*c* is not approximately in the shape of a circle, the pitch between the respective through holes 2*c* indicates a center axis-to-center axis distance of the virtual maximum cylinder falling into the through hole 2*c*.

The frame 3 is provided on the first surface 2*a* of the substrate 2. Specifically, the frame 3 is fixed to the first surface 2*a* of the substrate 2 by an adhesive layer 5. It is preferable that an adhesive material having less emitted gas (for example, glass with a low melting point, a vacuum adhesive agent, and the like) is used as the material of the adhesive layer 5. The frame 3 has approximately the same outer shape as that of the substrate 2 when seen from the thickness direction of the substrate 2. An opening 3*a* is formed in the frame 3. A portion corresponding to the opening 3*a* in the substrate 2 functions as an effective region R for moving a component of a sample described below to the first surface 2*a* side.

The frame 3, for example, is formed into the shape of a rectangular plate by the insulating material. The length of one side of the frame 3 when seen from the thickness direction of the substrate 2, for example, is approximately several cm, and the thickness of the frame 3, for example, is less than or equal to 1 mm. The opening 3*a*, for example, is in the shape of a circle when seen from the thickness direction of the substrate 2, and in such a case, the diameter of the opening 3*a*, for example, is approximately several mm to several tens of mm. By such a frame 3, the handling of the sample support body 1 is facilitated, and the deformation of the substrate 2 due to a temperature change or the like is suppressed.

The conductive layer 4 is provided on the first surface 2*a* of the substrate 2. Specifically, the conductive layer 4 is formed in a region corresponding to the opening 3*a* of the frame 3 on the first surface 2*a* of the substrate 2 (that is, a region corresponding to the effective region R), and is continuously (integrally) formed on an inner surface of the opening 3*a*, and a surface 3*b* of the frame 3 on a side opposite to the substrate 2. In the effective region R, the conductive layer 4 covers a portion in which the through hole 2*c* is not formed on the first surface 2*a* of the substrate 2. That is, in the effective region R, each of the through holes 2*c* is exposed to the opening 3*a*.

The conductive layer 4 is formed of a conductive material. However, it is preferable that a metal having low affinity (reactivity) with respect to a sample S and high conductivity is used as the material of the conductive layer 4, from the following reasons.

For example, in a case where the conductive layer 4 is formed of a metal such as copper (Cu) having high affinity with respect to a sample such as protein, in a process of ionizing the sample described below, the sample is ionized in a state where Cu atoms are attached to sample molecules. As a result thereof, there is a concern that a detection result is shifted in the mass spectrometry method described below as the Cu atoms are attached. Therefore, it is preferable that a metal having low affinity with respect to the sample is used as the material of the conductive layer 4.

On the other hand, a metal having high conductivity easily and stably applies a constant voltage. For this reason, in a case where the conductive layer 4 is formed of the metal having high conductivity, it is possible to homogeneously apply a voltage to the first surface 2*a* of the substrate 2 in the effective region R. In addition, there is a tendency that the metal having high conductivity also has high thermal conductivity. For this reason, in a case where the conductive layer 4 is formed of the metal having high conductivity, it is possible to efficiently transfer the energy of laser beam that is applied to the substrate 2 to the sample via the conductive layer 4. Therefore, it is preferable that the metal having high conductivity is used as the material of the conductive layer 4.

From the viewpoint described above, for example, it is preferable that gold (Au), platinum (Pt), and the like are used as the material of the conductive layer 4. The conductive layer 4, for example, is formed to have a thickness of approximately 1 nm to 350 nm by a plating method, an atomic layer deposition (ALD) method, a vapor deposition method, a sputtering method, and the like. Note that, for example, chromium (Cr), nickel (Ni), titanium (Ti), and the like may be used as the material of the conductive layer 4.

Figure 3:
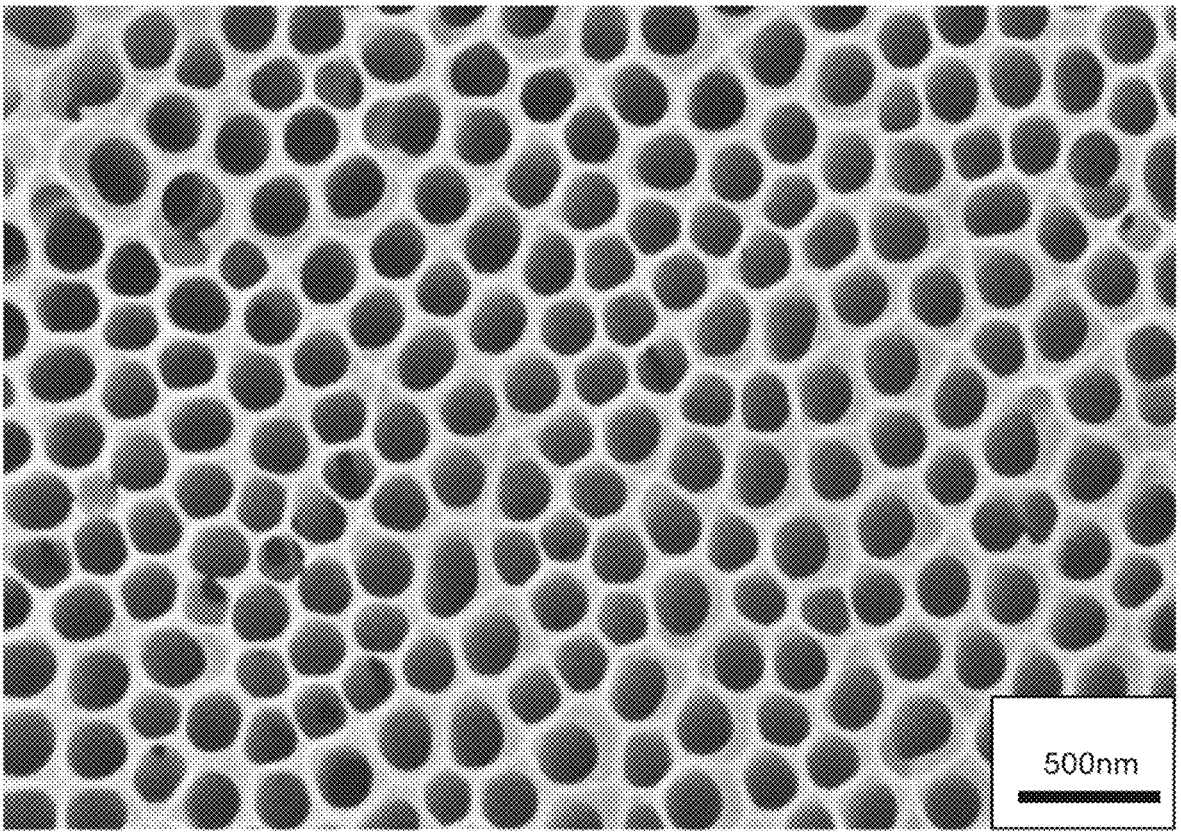
FIG. 3 is a diagram illustrating an enlarged image of a substrate of the sample support body illustrated in FIG. 1.

FIG. 3 is a diagram illustrating an enlarged image of the substrate 2 when seen from the thickness direction of the substrate 2. In FIG. 3, a black portion is the through hole 2*c*, and a white portion is a partition portion between the through holes 2*c*. As illustrated in FIG. 3, the plurality of through holes 2*c* having an approximately constant width are uniformly formed on the substrate 2. It is preferable that an opening rate of the through holes 2*c* in the effective region R (a ratio of all of the through holes 2*c* to the effective region R when seen from the thickness direction of the substrate 2) is practically 10% to 80%, and is particularly 60% to 80%. The sizes of the plurality of through holes 2*c* may be uneven with each other, and the plurality of through holes 2*c* may be partially connected to each other.

The substrate 2 illustrated in FIG. 3 is an alumina porous film that is formed by performing anodic oxidation with respect to aluminum (Al). Specifically, an anodic oxidation treatment is performed with respect to an Al substrate, and a surface portion that is oxidized is peeled off from the Al substrate, and thus, it is possible to obtain the substrate 2. Note that, the substrate 2 may be formed by performing anodic oxidation with respect to a valve metal other than Al, such as tantalum (Ta), niobium (Nb), titanium (Ti), hafnium (Hf), zirconium (Zr), zinc (Zn), tungsten (W), bismuth (Bi), and antimony (Sb), or may be formed by performing anodic oxidation with respect to silicon (Si).

Figure 4:
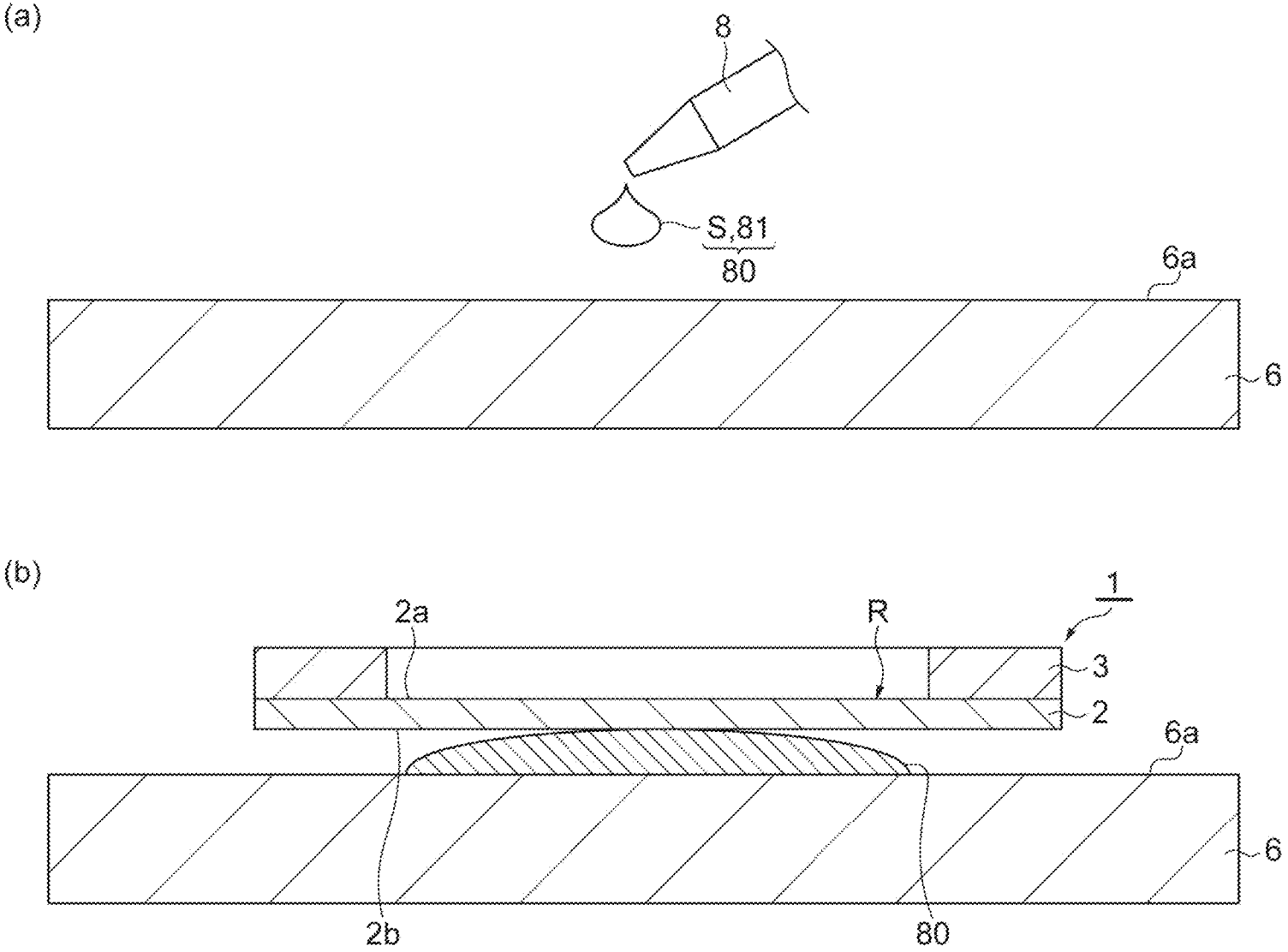
FIG. 4 is a diagram illustrating steps of the mass spectrometry method of the first embodiment.
Figure 5:
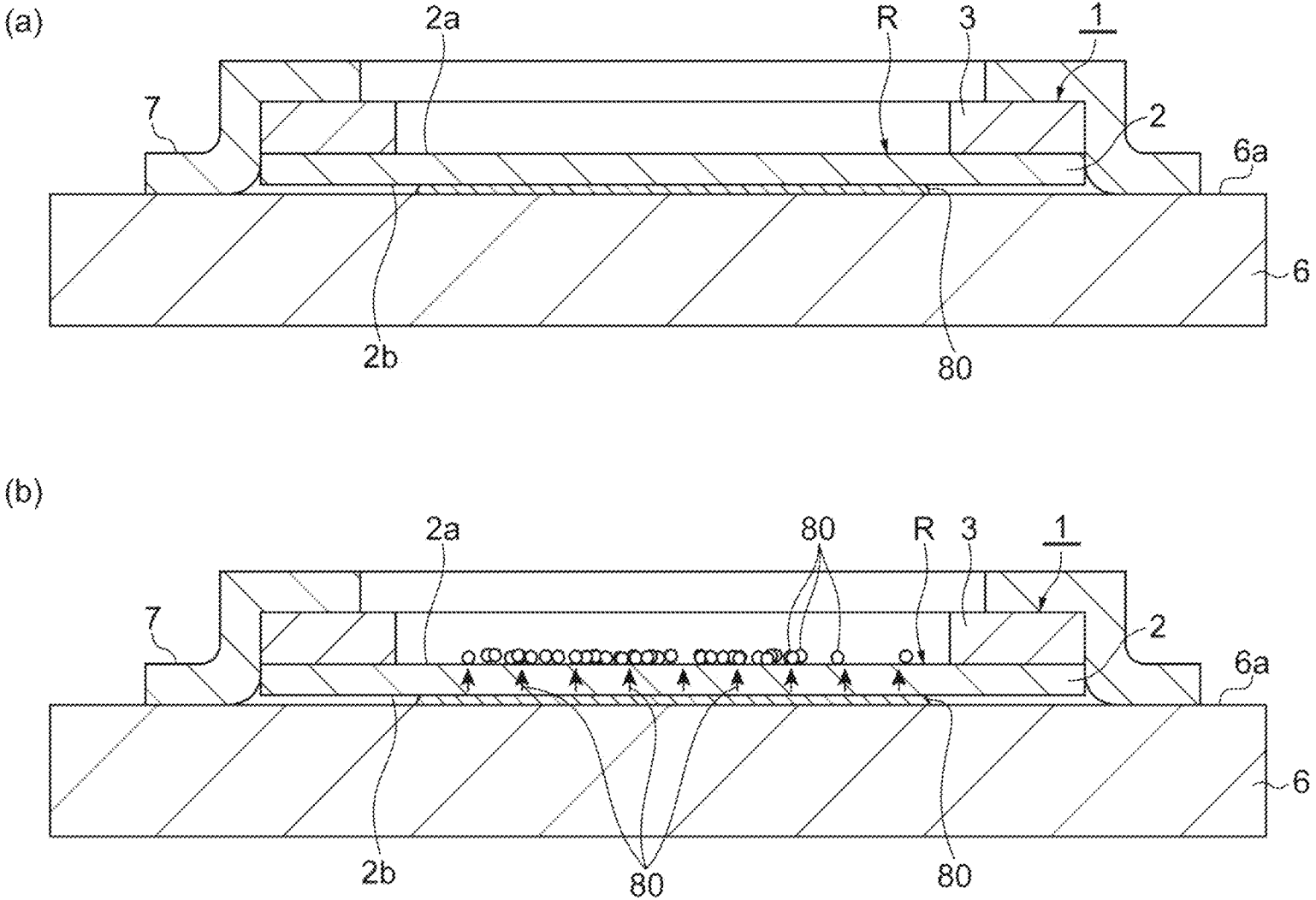
FIG. 5 is a diagram illustrating the steps of the mass spectrometry method of the first embodiment.
Figure 6:
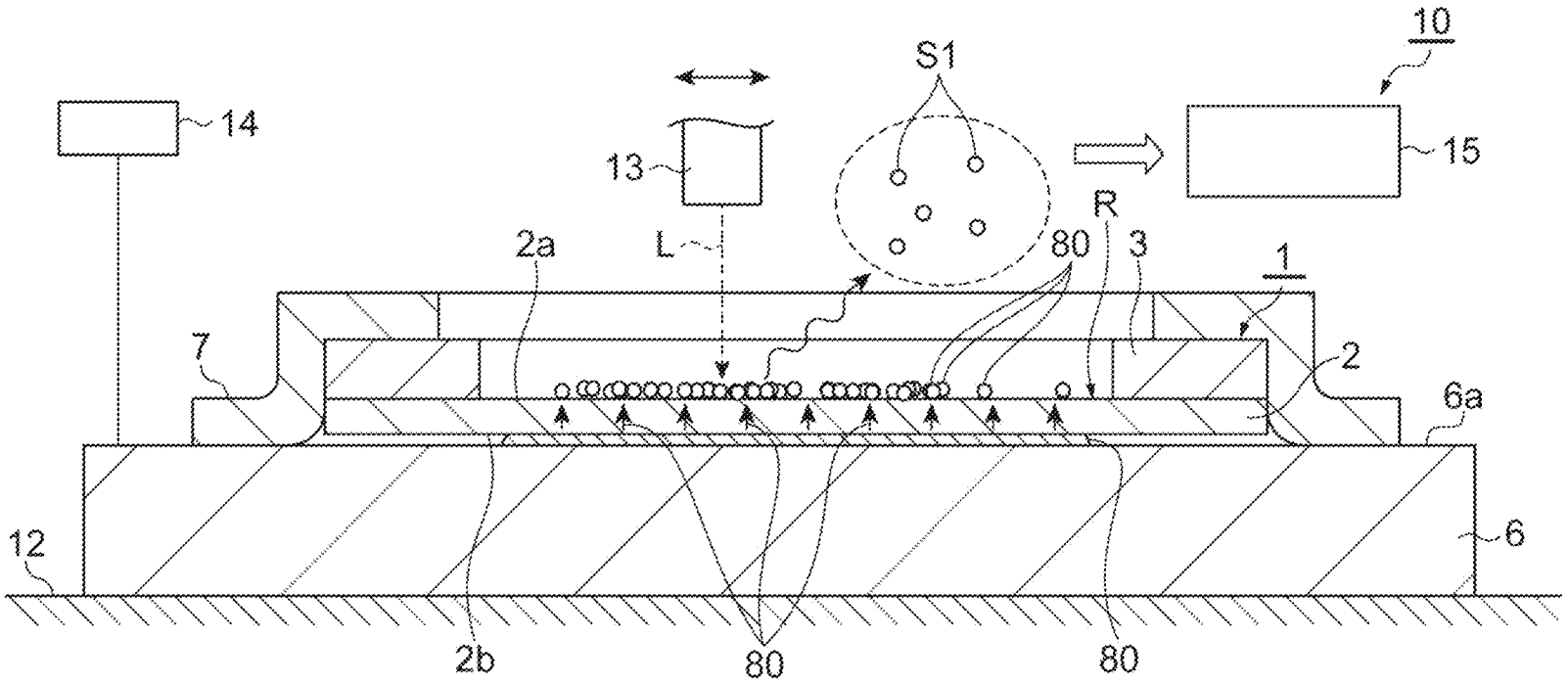
FIG. 6 is a diagram illustrating the steps of the mass spectrometry method of the first embodiment.

Next, the laser desorption/ionization method and the mass spectrometry method of the first embodiment will be described. In FIG. 4 to FIG. 6, the through hole 2*c*, the conductive layer 4, and the adhesive layer 5 in the sample support body 1 are not illustrated. In addition, for the convenience of illustration, a dimensional ratio or the like is different between the sample support body 1 illustrated in FIG. 1 and FIG. 2 and the sample support body 1 illustrated in FIG. 4 to FIG. 6.

First, the sample support body 1 described above is prepared (a first step). The sample support body 1 may be prepared by being manufactured by a person who carries out the laser desorption/ionization method and the mass spectrometry method, or may be prepared by being acquired from a manufacturer, a seller, or the like of the sample support body 1.

Subsequently, the sample that is a mass spectrometry target and a solvent are introduced into the plurality of through holes 2*c* (a second step). Specifically, as illustrated in (a) of FIG. 4, a mixed liquid 80 of the sample S and a solvent 81, for example, is dropped onto a mounting surface 6*a* of a glass slide (a mounting portion) 6 by a pipette 8. The glass slide 6 is a glass substrate on which a transparent conductive film such as an indium tin oxide (ITO) film is formed, and the surface of the transparent conductive film is the mounting surface 6*a*. Note that, not only the glass slide 6 but also a member that is capable of ensuring conductivity (for example, a substrate formed of a metal material such as stainless steel, or the like) can be used as the mounting portion. Subsequently, as illustrated in (b) of FIG. 4, the sample support body 1 is disposed on the mixed liquid 80 such that the second surface 2*b* is in contact with the mixed liquid 80. At this time, the mixed liquid 80 is disposed in the effective region R when seen from the thickness direction of the substrate 2.

Here, the mixed liquid 80 is a solution containing the sample S and the solvent 81. The sample S, for example, is a peptide sample. The solvent 81, for example, is an organic solvent. The solvent 81 has refractoriness in a vacuum. "Having refractoriness in a vacuum" indicates having refractoriness higher than that of water in a vacuum. That is, "having refractoriness in a vacuum" indicates having less volatility than that of water in a vacuum. "Having refractoriness in a vacuum" indicates that volatility in a vacuum is lower than volatility of water in vacuum.

In the atmosphere, the volatility of the solvent 81 is lower than the volatility of water. In a vacuum, the volatility of the solvent 81 is lower than the volatility of water. In the atmosphere, the volatility of the solvent 81 is lower than the volatility of acetone. In a vacuum, the volatility of the solvent 81 is lower than the volatility of acetone. In the atmosphere, the volatility of the solvent 81 is lower than the volatility of acetonitrile. In a vacuum, the volatility of the solvent 81 is lower than the volatility of acetonitrile. In the atmosphere, the solvent 81 is in a liquid form, and has fluidity. In a vacuum, the solvent 81 is in a liquid form, and has fluidity. In the atmosphere, a surface tension of the solvent 81 is lower than a surface tension of water. In a vacuum, the surface tension of the solvent 81 is lower than the surface tension of water. The solvent 81, for example, is glycerin (glycerol).

Subsequently, as illustrated in (a) of FIG. 5, the sample support body 1 is fixed to the glass slide 6, in a state in which the second surface 2*b* of the substrate 2 is brought into contact with the mixed liquid 80. At this time, the sample support body 1 is fixed to the glass slide 6 by a tape 7 having conductivity (for example, a carbon tape or the like). Specifically, the tape 7 is in contact with the conductive layer 4 on the first surface 2*a* of the substrate 2, and is in contact with the mounting surface 6*a* of the glass slide 6, and thus, the sample support body 1 is fixed to the glass slide 6. The tape 7 may be a part of the sample support body 1, or may be prepared separately from the sample support body 1. In a case where the tape 7 is a part of the sample support body 1 (that is, in a case where the sample support body 1 includes the tape 7), for example, the tape 7 may be fixed in advance to the first surface 2*a* side in a peripheral portion of the substrate 2. More specifically, the tape 7 may be fixed onto the conductive layer 4 in the peripheral portion of the substrate 2. As illustrated in (b) of FIG. 5, the mixed liquid 80 is moved towards the first surface 2*a* side from the second surface 2*b* side of the sample support body 1 through each of the through holes 2*c*. Then, the mixed liquid 80 is remained on the first surface 2*a* side of the sample support body 1 in each of the through holes 2*c* by a surface tension.

Subsequently, as illustrated in FIG. 6, the glass slide 6, the sample support body 1, and the mixed liquid 80 are mounted on a support portion 12 (for example, a stage) of a mass spectrometry device 10, in a state where the sample support body 1 and the mixed liquid 80 are mounted on the mounting surface 6*a* of the glass slide 6. Subsequently, an environment in which the glass slide 6, the sample support body 1, and the mixed liquid 80 are mounted is a vacuum state. Subsequently, a voltage is applied to the conductive layer 4 of the sample support body 1 via the mounting surface 6*a* of the glass slide 6 and the tape 7 by a voltage application unit 14 of the mass spectrometry device 10 (a third step). Subsequently, the first surface 2*a* of the substrate 2 is irradiated with laser beam L through the opening 3*a* of the frame 3 by a laser beam irradiation unit 13 of the mass spectrometry device 10 (the third step).

That is, the laser beam L is applied to a region corresponding to the opening 3*a* of the frame 3 on the first surface 2*a* of the substrate 2 (that is, a region corresponding to the effective region R). Here, the laser beam irradiation unit 13 is capable of irradiating regions that correspond to the effective region R and are different from each other, with the laser beam L. Note that, the irradiation of the laser beam L with respect to the regions different from each other can be performed by operating at least one of the support portion 12 and the laser beam irradiation unit 13.

As described above, the first surface 2*a* of the substrate 2 is irradiated with the laser beam L while a voltage is applied to the conductive layer 4. Accordingly, a component of the sample S in the mixed liquid 80 that is moved to the first surface 2*a* side of the substrate 2 is ionized, and a sample ion S1 (the component that is ionized) is emitted. Specifically, the conductive layer 4, and the solvent 81 that is moved to the first surface 2*a* side of the substrate 2, along with the sample S, absorb the energy of the laser beam L. The solvent 81 is gasified along with the component of the sample S by the energy. Then, a proton or a cation is added to the molecules of the component of the sample S that is gasified, and thus, the sample ion S1 is obtained. The first step to the third step described above correspond to the laser desorption/ionization method using the sample support body 1.

The sample ion S1 that is emitted is moved towards a ground electrode (not illustrated) that is provided between the sample support body 1 and an ion detection unit 15 while being accelerated. That is, the sample ion S1 is moved towards the ground electrode while being accelerated by a potential difference that occurs between the conductive layer 4 to which the voltage is applied and the ground electrode. Then, the sample ion S1 is detected by the ion detection unit 15 of the mass spectrometry device 10 (a fourth step). Here, the ion detection unit 15 detects the sample ion S1 to correspond to an irradiation position of the laser beam L. Note that, here, the mass spectrometry device 10 is a mass spectrometry device using a time-of-flight mass spectrometry (TOF-MS) method. The first step to the fourth step described above correspond to the mass spectrometry method using the sample support body 1.

As described above, in the laser desorption/ionization method of the first embodiment, the sample S and the solvent 81 are introduced into the plurality of through holes 2*c*. The component of the sample S is remained on the first surface 2*a* side in each of the through holes 2*c*, along with the solvent 81. Then, in a case where the first surface 2*a* is irradiated with the laser beam L while the voltage is applied to the conductive layer 4, the energy is transmitted to the component of the sample S on the first surface 2*a* side. Accordingly, the component of the sample S is ionized. In the laser desorption/ionization method, the solvent 81 has refractoriness in a vacuum. For this reason, the solvent 81 is more reliably remained on the first surface 2*a* side, compared to a case where the solvent has volatility in a vacuum. Therefore, the component of the sample S is also more reliably remained on the first surface 2*a* side. That is, the solvent 81 and the sample S are remained on the first surface 2*a* side for a longer period of time. Accordingly, when the first surface 2*a* is irradiated with the laser beam L while the voltage is applied to the conductive layer 4, the component of the sample S is more reliably ionized. That is, the solvent 81 and the component of the sample S are remained on the first surface 2*a* side for a longer period of time, and thus, the component of the sample S can be ionized by applying the laser beam L while applying the voltage for a longer period of time. Accordingly, it is possible to ionize the components of more samples S. As described above, according to the laser desorption/ionization method, in the mass spectrometry, it is possible to improve a detection intensity of the ionized sample S. That is, when the mass spectrometry is performed with respect to the same samples, it is possible to improve the sensitivity of the mass spectrometry, compared to a case where the sample is not reliably ionized.

In addition, in the laser desorption/ionization method of the first embodiment, in the second step, the mixed liquid 80 is dropped onto the mounting surface 6*a* of the glass slide 6, and the sample support body 1 is disposed on the mixed liquid 80 such that the second surface 2*b* is in contact with the mixed liquid 80. In this case, the mixed liquid 80 is moved to the first surface 2*a* side from the second surface 2*b* side through each of the through holes 2*c*, and is remained on the first surface 2*a* side in each of the through holes 2*c*. Then, as described above, the component of the sample S is more reliably remained on the first surface 2*a* side, and is more reliably ionized. Accordingly, in the mass spectrometry, it is possible to improve the detection intensity of the ionized sample S.

According to the mass spectrometry method of the first embodiment, it is possible to improve the detection intensity of the ionized sample S.

FIG. 7 is a diagram illustrating results of a mass spectrometry method of a comparative example and an example. In the comparative example, a solution mixed as Angiotensin II (the sample S):Diammonium Citrate (DHC):Citric Acid (CHAc):Acetonitrile (ACN)=1:1:1:1 (Angiotensin 1 mM, DHC:0.2 M, CHAc:0.2 M, and ACN) was prepared, and a mass spectrum was measured by using the sample support body 1 and the solution. (a) of FIG. 7 is a diagram illustrating a result thereof. In the comparative example, the detection intensity of the ionized sample S began to attenuate when one portion of the effective region R was irradiated with the laser beam L for 20 pulses. It is considered that this is because molecules mixed with the sample S were volatilized. For this reason, three portions of the effective region R were irradiated with the laser beam L for each 20 pulses, and an integrated value of detection results was obtained.

In the example, a solution mixed as Angiotensin II (the sample S):Glycerin (the solvent 81)=1:1 was prepared, and a mass spectrum was measured by using the sample support body 1 and the solution. (b) of FIG. 7 is a diagram illustrating a result thereof. In the example, one portion of the effective region R was irradiated with the laser beam L for 500 pulses, in the same condition as that of the comparative example. In the example, the detection intensity of the ionized sample was not attenuated when the laser beam L was applied for at least 20 pulses. This is because the sample S is remained on the first surface 2*a* side for a long period of time, along with the solvent 81. As illustrated in (a) of FIG. 7 and (b) of FIG. 7, in the detection intensity of Angiotensin II (m/z=1049) per one portion of the effective region R, the detection intensity of the example was approximately 60 times the detection intensity of the comparative example. Accordingly, it was proved that in the mass spectrometry, it was possible to improve the detection intensity of the ionized sample S by using the sample support body 1 and the solvent 81.

Second Embodiment

Next, the laser desorption/ionization method and the mass spectrometry method of the second embodiment will be described. The laser desorption/ionization method and the mass spectrometry method of the second embodiment are mainly different from the laser desorption/ionization method and the mass spectrometry method of the first embodiment in that in the second step of introducing the sample and the solvent into the plurality of through holes 2*c*, the sample support body 1 is mounted on the mounting surface 6*a* of the glass slide 6, and then, the mixed liquid 80 is dropped onto the sample support body 1. In the laser desorption/ionization method and the mass spectrometry method of the second embodiment, the others are the same as the laser desorption/ionization method and the mass spectrometry method of the first embodiment, and thus, the detailed description will be omitted. In FIG. 8 and FIG. 9, the through hole 2*c*, the conductive layer 4, and the adhesive layer 5 in the sample support body 1 are not illustrated. In addition, for the convenience of illustration, a dimensional ratio or the like is different between the sample support body 1 illustrated in FIG. 1 and FIG. 2 and the sample support body 1 illustrated in FIG. 8 and FIG. 9.

First, as illustrated in (a) of FIG. 8, the sample support body 1 described above is prepared (a first step). Subsequently, the sample and the solvent are introduced into the plurality of through holes 2*c* (a second step). Specifically, as illustrated in (b) of FIG. 8, the sample support body 1 is mounted on the mounting surface 6*a* such that the second surface 2*b* faces the mounting surface 6*a*. Subsequently, as illustrated in (a) of FIG. 9, as with the first embodiment, the sample support body 1 is fixed to the glass slide 6 by the tape 7. Subsequently, as illustrated in (b) of FIG. 9, the mixed liquid 80, for example, is dropped into the plurality of through holes 2*c* from the first surface 2*a* by the pipette 8. The mixed liquid 80 is moved towards the second surface 2*b* side from the first surface 2*a* side of the sample support body 1 through each of the through holes 2*c*. Each of the through holes 2*c* is filled with the mixed liquid 80. The mixed liquid 80 is remained on the first surface 2*a* side of the sample support body 1 in each of the through holes 2*c* by the surface tension.

Subsequently, as with the first embodiment (refer to FIG. 6), the first surface 2*a* of the substrate 2 is irradiated with the laser beam L while the voltage is applied to the conductive layer 4. Accordingly, the component of the sample S in the mixed liquid 80 that is remained on the first surface 2*a* side of the substrate 2 is ionized, and the sample ion S1 (the ionized component) is emitted (a third step). Then, as with the first embodiment, the sample ion S1 is detected by the ion detection unit 15 of the mass spectrometry device 10 (a fourth step). Note that, the laser desorption/ionization method of the second embodiment includes each of the steps from the first step to the third step described above. The mass spectrometry method of the second embodiment includes each of the steps from the first step to the fourth step described above.

As described above, in the laser desorption/ionization method of the second embodiment, in the second step, the sample support body 1 is mounted on the mounting surface 6*a* such that the second surface 2*b* faces the mounting surface 6*a* of the glass slide 6, and the mixed liquid 80 is dropped into the plurality of through holes 2*c* from the first surface 2*a* side. Even in such a case, the mixed liquid 80 is remained on the first surface 2*a* side in each of the through holes 2*c*. Then, as with the first embodiment, the component of the sample S is more reliably remained on the first surface 2*a* side, and is more reliably ionized. Accordingly, in the mass spectrometry, it is possible to improve the detection intensity of the ionized sample S.

Third Embodiment

Next, the laser desorption/ionization method and the mass spectrometry method of the third embodiment will be described. The laser desorption/ionization method and the mass spectrometry method of the third embodiment are mainly different from the laser desorption/ionization method and the mass spectrometry method of the first embodiment in that in the second step, the sample and the solvent are not introduced into the through hole 2*c* of the sample support body 1 as a mixed liquid. In the laser desorption/ionization method and the mass spectrometry method of the third embodiment, the others are the same as the laser desorption/ionization method and the mass spectrometry method of the first embodiment, and thus, the detailed description will be omitted. In FIG. 10 to FIG. 12, the through hole 2*c*, the conductive layer 4, and the adhesive layer 5 in the sample support body 1 are not illustrated. In addition, for the convenience of illustration, a dimensional ratio or the like is different between the sample support body 1 illustrated in FIG. 1 and FIG. 2 and the sample support body 1 illustrated in FIG. 10 to FIG. 12.

First, the sample support body 1 described above is prepared (a first step). Subsequently, the sample and the solvent are introduced into the plurality of through holes 2*c* (a second step). Specifically, as illustrated in (a) of FIG. 10, the sample S is mounted on the mounting surface 6*a* of the glass slide 6. Subsequently, as illustrated in (b) of FIG. 10, the sample support body 1 is disposed on the sample S such that the second surface 2*b* is in contact with the sample S. At this time, the sample S is disposed in the effective region R when seen from the thickness direction of the substrate 2. Here, the sample S, for example, is a human hair. The sample S is a dry sample. In addition, in order to smoothly move the component of the sample S, a solution (for example, an acetonitrile mixed liquid or the like) for decreasing the viscosity of the component of the sample S may be mixed with the sample S. Subsequently, as illustrated in (a) of FIG. 11, as with the first embodiment, the sample support body 1 is fixed to the glass slide 6 by the tape 7.

Subsequently, as illustrated in (b) of FIG. 11, the solvent 81 is introduced into the plurality of through holes 2*c* of the sample support body 1. Specifically, the solvent 81, for example, is dropped into the plurality of through holes 2*c* from the first surface 2*a* side of the sample support body 1 by the pipette 8. The solvent 81 is dropped onto approximately the entire region of the effective region R to reach the entire region of the sample S. More preferably, the solvent 81, for example, is applied into the plurality of through holes 2*c* from the first surface 2*a* side of the sample support body 1 with approximately a uniform amount by an airbrush or the like. The solvent 81 is moved towards the second surface 2*b* side from the first surface 2*a* side of the sample support body 1 through each of the through holes 2*c*. Then, the solvent 81 is mixed with the component of the sample S that is in contact with the second surface 2*b* of the sample support body 1 in each of the through holes 2*c*.

As illustrated in (a) of FIG. 12, the component of the sample S is mixed with the solvent 81 that is moved to the second surface 2*b* side of the sample support body 1 and is moved towards the first surface 2*a* side from the second surface 2*b* side of the sample support body 1 through each of the through holes 2*c*, in each of the through holes 2*c*. The mixed liquid 80 of the component of the sample S and the solvent 81 is remained on the first surface 2*a* side of the sample support body 1 in each of the through holes 2*c* by the surface tension.

Subsequently, as illustrated in (b) of FIG. 12, the first surface 2*a* of the substrate 2 is irradiated with the laser beam L while the voltage is applied to the conductive layer 4, in a state where the sample S is disposed between the glass slide 6 and the sample support body 1. Accordingly, the component of the sample S that is mixed with the solvent 81 and is moved to the first surface 2*a* side from the second surface 2*b* side through the through hole 2*c* is ionized, and the sample ion S1 (the ionized component) is emitted (a third step). Here, the laser beam irradiation unit 13 scans the region corresponding to the effective region R with the laser beam L. Note that, the scanning of the laser beam L with respect to the region corresponding to the effective region R can be performed by operating at least one of the support portion 12 and the laser beam irradiation unit 13.

Then, the sample ion S1 is detected by the ion detection unit 15 of the mass spectrometry device 10 (a fourth step). Here, the ion detection unit 15 detects the sample ion S1 to corresponding to a scanning position of the laser beam L. Accordingly, it is possible to image a two-dimensional distribution of the molecules configuring the sample S. Note that, the laser desorption/ionization method of the third embodiment includes each of the steps from the first step to the third step described above. The mass spectrometry method of the third embodiment includes each of the steps from the first step to the fourth step described above.

As described above, in the laser desorption/ionization method of the third embodiment, in the second step, the sample S is mounted on the mounting surface 6*a* of the glass slide 6, the sample support body 1 is disposed on the sample S such that the second surface 2*b* is in contact with the sample S, and then, the solvent 81 is introduced into the plurality of through holes 2*c*, and in the third step, the component of the sample S that is mixed with the solvent 81 and is moved to the first surface 2*a* side from the second surface 2*b* side through the through hole 2*c* is ionized. In this case, the solvent 81 is moved to the second surface 2*b* side from the first surface 2*a* side through each of the through holes 2*c*, and is mixed with the component of the sample S. The component of the sample S is mixed with the solvent 81 and is moved to the first surface 2*a* side from the second surface 2*b* side through each of the through holes 2*c*. The component of the sample S is remained on the first surface 2*a* side, along with the solvent 81. As described above, the component of the sample S is extracted to the first surface 2*a* side from the second surface 2*b* side through the plurality of through holes 2*c* by the solvent 81. In the laser desorption/ionization method, the solvent 81 has refractoriness in a vacuum. For this reason, the solvent 81 is more reliably remained on the first surface 2*a* side, compared to a case where the solvent has volatility in a vacuum. Therefore, the component of the sample S that is extracted by the solvent 81 is also more reliably remained on the first surface 2*a* side. That is, the solvent 81 is remained on the first surface 2*a* side and in each of the through holes 2*c* for a longer period of time, and the sample S is extracted to the first surface 2*a* side by the solvent 81 for a longer period of time. Accordingly, when the first surface 2*a* is irradiated with the laser beam L while the voltage is applied to the conductive layer 4, the component of the sample S is more reliably ionized. That is, the solvent 81 and the component of the sample S are remained on the first surface 2*a* side for a longer period of time, and thus, it is possible to ionize the component of the sample S by applying the laser beam L while applying the voltage for a longer period of time. Accordingly, it is possible to ionize the components of more samples S. As described above, according to the laser desorption/ionization method, in the mass spectrometry, it is possible to improve the detection intensity of the ionized sample S.

In the laser desorption/ionization method of the third embodiment, in the second step, the solvent 81 is dropped into the plurality of through holes 2*c* from the first surface 2*a* side. In this case, it is possible to easily introduce the solvent 81 into each of the through holes 2*c*.

In the laser desorption/ionization method of the third embodiment, the sample S is the dry sample. In the laser desorption/ionization method, the component of the sample S is mixed with the solvent 81 and is moved, and thus, even in a case where the sample S is the dry sample, it is possible to smoothly move the component of the sample S.

Fourth Embodiment

Next, the laser desorption/ionization method and the mass spectrometry method of the fourth embodiment will be described. The laser desorption/ionization method and the mass spectrometry method of the fourth embodiment are mainly different from the laser desorption/ionization method and the mass spectrometry method of the third embodiment in that in the second step, the solvent 81 is introduced into the through hole 2*c* of the sample support body 1, and then, the sample support body 1 into which the solvent 81 is introduced is disposed on the sample S. In the laser desorption/ionization method and the mass spectrometry method of the fourth embodiment, the others are the same as the laser desorption/ionization method and the mass spectrometry method of the third embodiment, and thus, the detailed description will be omitted. In FIG. 13 and FIG. 14, the through hole 2*c*, the conductive layer 4, and the adhesive layer 5 in the sample support body 1 are not illustrated. In addition, for the convenience of illustration, a dimensional ratio or the like is different between the sample support body 1 illustrated in FIG. 1 and FIG. 2 and the sample support body 1 illustrated in FIG. 13 and FIG. 14.

First, as illustrated in (a) of FIG. 13, the sample support body 1 described above is prepared (a first step). Subsequently, the sample and the solvent are introduced into the plurality of through holes 2*c* (a second step). Specifically, the solvent 81 is introduced into the plurality of through holes 2*c* of the sample support body 1. The solvent 81, for example, is dropped into the plurality of through holes 2*c* from the first surface 2*a* side of the sample support body 1 by the pipette 8. The solvent 81 is dropped onto approximately the entire region of the effective region R. More preferably, the solvent 81, for example, is applied into the plurality of through holes 2*c* from the first surface 2*a* side of the sample support body 1 with approximately a uniform amount by an airbrush or the like. The solvent 81 is moved towards the second surface 2*b* side from the first surface 2*a* side of the sample support body 1 through each of the through holes 2*c*. Each of the through holes 2*c* is filled with the solvent 81.

Subsequently, as illustrated in (b) of FIG. 13, the sample S is mounted on the mounting surface 6*a* of the glass slide 6. Subsequently, as illustrated in (a) of FIG. 14, the sample support body 1 is disposed on the sample S such that the second surface 2*b* is in contact with the sample S. Subsequently, as illustrated in (b) of FIG. 14, as with the first embodiment, the sample support body 1 is fixed to the glass slide 6 by the tape 7. The solvent 81 in each of the through holes 2*c* is mixed with the component of the sample S that is in contact with the second surface 2*b* of the sample support body 1, in each of the through holes 2*c*. The component of the sample S is mixed with the solvent 81 and is moved towards the first surface 2*a* side from the second surface 2*b* side of the sample support body 1 through each of the through holes 2*c*. The mixed liquid 80 of the component of the sample S and the solvent 81 is remained on the first surface 2*a* side of the sample support body 1 in each of the through holes 2*c* by the surface tension.

Subsequently, as with the third embodiment (refer to (b) of FIG. 12), the first surface 2*a* of the sample support body 1 is irradiated with the laser beam L by the laser beam irradiation unit 13 while the voltage is applied to the conductive layer 4 by the voltage application unit 14, in a state where the sample S is disposed between the glass slide 6 and the sample support body 1. Accordingly, the component of the sample S that is moved to the first surface 2*a* side of the substrate 2 is ionized, and the sample ion S1 (the ionized component) is emitted (a third step). Then, as with the third embodiment, the sample ion S1 is detected by the ion detection unit 15 of the mass spectrometry device 10 (a fourth step). Note that, the laser desorption/ionization method of the fourth embodiment includes each of the steps from the first step to the third step described above. The mass spectrometry method of the fourth embodiment includes each of the steps from the first step to the fourth step described above.

As described above, in the laser desorption/ionization method of the fourth embodiment, in the second step, the solvent 81 is introduced into the plurality of through holes 2*c*, the sample S is mounted on the mounting surface 6*a* of the glass slide 6, and then, the sample support body 1 is disposed on the sample S such that the second surface 2*b* is in contact with the sample S, and in the third step, the component of the sample S that is mixed with the solvent 81 and is moved to the first surface 2*a* side from the second surface 2*b* side through the through hole 2*c* is ionized. In this case, the component of the sample S is mixed with the solvent 81 and is moved to the first surface 2*a* side from the second surface 2*b* side through each of the through holes 2*c*. The component of the sample S is remained on the first surface 2*a* side, along with the solvent 81. As described above, the component of the sample S is extracted to the first surface 2*a* side from the second surface 2*b* side through the plurality of through holes 2*c* by the solvent 81. Then, as with the third embodiment, the component of the sample S is more reliably remained on the first surface 2*a* side, and is more reliably ionized. Accordingly, in the mass spectrometry, it is possible to improve the detection intensity of the ionized sample S.

In addition, in the laser desorption/ionization method of the fourth embodiment, in the second step, the solvent 81 is dropped into the plurality of through holes 2*c* from the first surface 2*a* side. In this case, it is possible to easily introduce the solvent 81 into each of the through holes 2*c*.

The present disclosure is not limited to the embodiments described above. In each of the embodiments, for example, the conductive layer 4 may not be provided on the second surface 2*b* of the substrate 2 and the inner surface of the through hole 2*c*, insofar as the conductive layer 4 is provided on at least the first surface 2*a* of the substrate 2. In addition, the conductive layer 4 may be provided on the second surface 2*b* of the substrate 2 and the inner surface of the through hole 2*c*. In addition, the sample support body 1 may be fixed to the glass slide 6 by means other than the tape 7 (for example, means using an adhesive agent, a fixing tool, or the like).

In addition, in the third step of each of the embodiments, the voltage may be applied to the conductive layer 4 without using the mounting surface 6*a* of the glass slide 6 and the tape 7. In this case, the glass slide 6 and the tape 7 may not have conductivity. In addition, the substrate 2 may have conductivity, and in the third step, the voltage may be applied to the substrate 2. In this case, it is possible to omit the conductive layer 4 from the sample support body 1, and to obtain the same effect as that of a case where the sample support body 1 including the conductive layer 4 as described above is used.

In addition, in each of the embodiments, an example has been described in which the sample S is a peptide sample or a human hair, but the sample S may be various. In addition, in the third embodiment and the fourth embodiment, an example has been described in which the sample S is the dry sample, but the sample S may be a hydrous sample.

In addition, in each of the embodiments, an example has been described in which the solvent 81 is glycerin, but the solvent 81 may be a solvent having refractoriness in a vacuum. For example, the solvent 81 may be at least one selected from glycerin, diethanol amine, triethanol amine, nitrobenzyl alcohol, nitrophenyl octyl ether, thioglycerol, diethylene glycol, triethylene glycol, tetraethylene glycol, liquid paraffin, sulfolane, dithiothreitol, a mixture of dithiothreitol and thioglycerol, a mixture of dithiothreitol and nitrobenzyl alcohol, and a mixture of dithiothreitol and dithioerythritol. Even in a case where such a materials are used as the solvent 81, in the mass spectrometry, it is possible to improve the detection intensity of the ionized sample S.

In addition, in the third embodiment and the fourth embodiment, in the mass spectrometry device 10, the region corresponding to the effective region R may be irradiated with the laser beam L by the laser beam irradiation unit 13 at one time, and the sample ion S1 may be detected by the ion detection unit 15 while two-dimensional information of the region is maintained. That is, the mass spectrometry device 10 may be a projection mass spectrometry device.

In addition, the laser desorption/ionization method of each of the embodiments described above can be used not only in imaging mass spectrometry in which the mass spectrum of the sample S is measured or the two-dimensional distribution of the molecules configuring the sample S is imaged, but also in other measurements and tests such as ion mobility measurement.

In addition, in the fourth embodiment, an example has been described in which in the second step, the solvent 81 is dropped into the plurality of through holes 2*c* from first surface 2*a* side, but the solvent 81 may be dropped into the plurality of through holes 2*c* from the second surface 2*b* side. In addition, in the fourth embodiment, in the second step, the sample support body 1 may be dipped in the solvent 81. In addition, in the fourth embodiment, in the second step, the solvent 81 may be introduced into the plurality of through holes 2*c*, in a state of being heated and evaporated. Specifically, the solvent 81 that is introduced into the plurality of through holes 2*c* in the evaporated state is cooled at a normal temperature, and thus, fills each of the through holes 2*c*, and is in contact with the sample support body 1, and therefore, is remained in each of the through holes 2*c*. In any case, it is possible to easily introduce the solvent 81 into each of the through holes 2*c*.

In addition, in each of the embodiments, an example has been described in which the opening 3*a* of the frame 3 is in the shape of a circle when seen from the thickness direction of the substrate 2, but the opening 3*a* may have various shapes. The opening 3*a* of the frame 3, for example, may be in the shape of a rectangle.

In addition, in each of the embodiments, an example has been described in which the sample S is mounted on the glass slide 6, but the sample S may be directly mounted on the support portion 12 of the mass spectrometry device 10. At this time, the support portion 12 of the mass spectrometry device 10 corresponds to the glass slide 6.

In addition, the application of the sample support body 1 is not limited to the ionization of the sample S by the irradiation of the laser beam L. The sample support body 1 may be used in the ionization of the sample S by the irradiation of energy beam (for example, an ion beam, an electron beam, and the like) other than the laser beam L.

REFERENCE SIGNS LIST

1: sample support body, 2: substrate, 2*a*: first surface, 2*b*: second surface, 2*c*: through hole, 4: conductive layer, 6: glass slide (mounting portion), 6*a*: mounting surface, 80: mixed liquid, 81: solvent, L: laser beam, S: sample.

The invention claimed is:

1. A laser desorption/ionization method, comprising:

a first step of preparing a sample support body including a substrate on which a plurality of through holes opening to a first surface and a second surface facing each other are formed, and a conductive layer provided on at least the first surface;

a second step of introducing a sample and a solvent having refractoriness in a vacuum into the plurality of through holes; and a third step of ionizing a component of the sample by irradiating the first surface with a laser beam while applying a voltage to the conductive layer, wherein in the second step, the solvent is introduced into the plurality of through holes, the sample is mounted on a mounting surface of a mounting portion, and then, the sample support body is disposed on the sample such that the second surface is in contact with the sample, wherein in the third step, the component of the sample that is mixed with the solvent and is moved to the first surface side from the second surface side through the through hole is ionized by irradiating the first surface with the laser beam while applying the voltage to the conductive layer, in a state in which the sample is disposed between the mounting portion and the sample support body, and wherein in the second step, the sample support body is dipped in the solvent.

2. The laser desorption/ionization method according to claim 1, wherein the sample is a dry sample.

3. A laser desorption/ionization method, comprising:

a first step of preparing a sample support body including a substrate having conductivity on which a plurality of through holes opening to a first surface and a second surface facing each other are formed;

a second step of introducing a sample and a solvent having refractoriness in a vacuum into the plurality of through holes; and a third step of ionizing a component of the sample by irradiating the first surface with a laser beam while applying a voltage to the substrate, wherein in the second step, the solvent is introduced into the plurality of through holes, the sample is mounted on a mounting surface of a mounting portion, and then, the sample support body is disposed on the sample such that the second surface is in contact with the sample, wherein in the third step, the component of the sample that is mixed with the solvent and is moved to the first surface side from the second surface side through the through hole is ionized by irradiating the first surface with the laser beam while applying the voltage to the substrate, in a state in which the sample is disposed between the mounting portion and the sample support body, and wherein in the second step, the sample support body is dipped in the solvent.

4. The laser desorption/ionization method according to claim 1, wherein the solvent is at least one selected from glycerin, diethanol amine, triethanol amine, nitrobenzyl alcohol, nitrophenyl octyl ether, thioglycerol, diethylene glycol, triethylene glycol, tetraethylene glycol, liquid paraffin, sulfolane, dithiothreitol, a mixture of dithiothreitol and thioglycerol, a mixture of dithiothreitol and nitrobenzyl alcohol, and a mixture of dithiothreitol and dithioerythritol.

5. A mass spectrometry method, comprising:

a first step of preparing a sample support body including a substrate on which a plurality of through holes opening to a first surface and a second surface facing each other are formed, and a conductive layer provided on at least the first surface;

a second step of introducing a sample and a solvent having refractoriness in a vacuum into the plurality of through holes;

a third step of ionizing a component of the sample by irradiating the first surface with a laser beam while applying a voltage to the conductive layer; and a fourth step of detecting the component that is ionized in the third step, wherein in the second step, the solvent is introduced into the plurality of through holes, the sample is mounted on a mounting surface of a mounting portion, and then, the sample support body is disposed on the sample such that the second surface is in contact with the sample, wherein in the third step, the component of the sample that is mixed with the solvent and is moved to the first surface side from the second surface side through the through hole is ionized by irradiating the first surface with the laser beam while applying the voltage to the conductive layer, in a state in which the sample is disposed between the mounting portion and the sample support body, and wherein in the second step, the sample support body is dipped in the solvent.

6. A laser desorption/ionization method, comprising:

a first step of preparing a sample support body including a substrate on which a plurality of through holes opening to a first surface and a second surface facing each other are formed, and a conductive layer provided on at least the first surface;

a second step of introducing a sample and a solvent having refractoriness in a vacuum into the plurality of through holes; and a third step of ionizing a component of the sample by irradiating the first surface with a laser beam while applying a voltage to the conductive layer, wherein in the second step, the solvent is introduced into the plurality of through holes, the sample is mounted on a mounting surface of a mounting portion, and then, the sample support body is disposed on the sample such that the second surface is in contact with the sample, wherein in the third step, the component of the sample that is mixed with the solvent and is moved to the first surface side from the second surface side through the through hole is ionized by irradiating the first surface with the laser beam while applying the voltage to the conductive layer, in a state in which the sample is disposed between the mounting portion and the sample support body, and wherein in the second step, the solvent is introduced into the plurality of through holes in a state of being heated and evaporated.

7. The laser desorption/ionization method according to claim 6, wherein the sample is a dry sample.

8. The laser desorption/ionization method according to claim 6, wherein the solvent is at least one selected from glycerin, diethanol amine, triethanol amine, nitrobenzyl alcohol, nitrophenyl octyl ether, thioglycerol, diethylene glycol, triethylene glycol, tetraethylene glycol, liquid paraffin, sulfolane, dithiothreitol, a mixture of dithiothreitol and thioglycerol, a mixture of dithiothreitol and nitrobenzyl alcohol, and a mixture of dithiothreitol and dithioerythritol.

9. A mass spectrometry method, comprising:

a first step of preparing a sample support body including a substrate on which a plurality of through holes opening to a first surface and a second surface facing each other are formed, and a conductive layer provided on at least the first surface;

a second step of introducing a sample and a solvent having refractoriness in a vacuum into the plurality of through holes;

a third step of ionizing a component of the sample by irradiating the first surface with a laser beam while applying a voltage to the conductive layer; and a fourth step of detecting the component that is ionized in the third step, wherein in the second step, the solvent is introduced into the plurality of through holes, the sample is mounted on a mounting surface of a mounting portion, and then, the sample support body is disposed on the sample such that the second surface is in contact with the sample, wherein in the third step, the component of the sample that is mixed with the solvent and is moved to the first surface side from the second surface side through the through hole is ionized by irradiating the first surface with the laser beam while applying the voltage to the conductive layer, in a state in which the sample is disposed between the mounting portion and the sample support body, and wherein in the second step, the solvent is introduced into the plurality of through holes in a state of being heated and evaporated.

10. A laser desorption/ionization method, comprising:

a first step of preparing a sample support body including a substrate having conductivity on which a plurality of through holes opening to a first surface and a second surface facing each other are formed;

a second step of introducing a sample and a solvent having refractoriness in a vacuum into the plurality of through holes; and a third step of ionizing a component of the sample by irradiating the first surface with a laser beam while applying a voltage to the substrate, wherein in the second step, the solvent is introduced into the plurality of through holes, the sample is mounted on a mounting surface of a mounting portion, and then, the sample support body is disposed on the sample such that the second surface is in contact with the sample, wherein in the third step, the component of the sample that is mixed with the solvent and is moved to the first surface side from the second surface side through the through hole is ionized by irradiating the first surface with the laser beam while applying the voltage to the substrate, in a state in which the sample is disposed between the mounting portion and the sample support body, and wherein in the second step, the solvent is introduced into the plurality of through holes in a state of being heated and evaporated.

* * * * *